US009304462B2

(12) United States Patent
Chiyoda

(10) Patent No.: US 9,304,462 B2
(45) Date of Patent: Apr. 5, 2016

(54) IMAGE FORMING APPARATUS

(71) Applicant: CANON KABUSHIKI KAISHA, Tokyo (JP)

(72) Inventor: Yasuharu Chiyoda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/795,077

(22) Filed: Jul. 9, 2015

(65) Prior Publication Data

US 2016/0011544 A1 Jan. 14, 2016

(30) Foreign Application Priority Data

Jul. 11, 2014 (JP) ..... 2014-143330

(51) Int. Cl.
*G03G 15/20* (2006.01)

(52) U.S. Cl.
CPC ..... *G03G 15/206* (2013.01)

(58) Field of Classification Search
CPC ..... G03G 15/206
See application file for complete search history.

(56) References Cited

U.S. PATENT DOCUMENTS

| | | | |
|---|---|---|---|
| 7,430,392 | B2 | 9/2008 | Ito et al. |
| 8,145,086 | B2 | 3/2012 | Chiyoda et al. |
| 8,306,446 | B2 | 11/2012 | Ito et al. |
| 8,395,090 | B2 | 3/2013 | Chiyoda |
| 8,447,211 | B2 | 5/2013 | Takahashi et al. |
| 8,699,896 | B2 | 4/2014 | Ishigaya et al. |
| 8,873,986 | B2 | 10/2014 | Chiyoda |
| 9,075,355 | B2 | 7/2015 | Chiyoda et al. |
| 2008/0038027 | A1 | 2/2008 | Ito et al. |
| 2011/0091226 | A1 | 4/2011 | Ishigaya et al. |
| 2011/0129253 | A1 | 6/2011 | Takahashi et al. |
| 2013/0051826 | A1 | 2/2013 | Chiyoda |
| 2015/0016831 | A1 | 1/2015 | Chiyoda |
| 2015/0104205 | A1 | 4/2015 | Moteki et al. |

FOREIGN PATENT DOCUMENTS

| | | | |
|---|---|---|---|
| JP | H07-311505 | A | 11/1995 |
| JP | 2007-199596 | A | 8/2007 |
| JP | 2008-040363 | A | 2/2008 |
| JP | 4231756 | B2 | 3/2009 |
| JP | 5515695 | B2 | 6/2014 |
| JP | 5561036 | B2 | 7/2014 |

*Primary Examiner* — G. M. Hyder
(74) *Attorney, Agent, or Firm* — Fitzpatrick, Cella, Harper & Scinto

(57) ABSTRACT

An image forming apparatus includes a first heating rotator and a first pressing rotator forming a fixing nip fixing a non-fixed toner image formed in an image forming portion onto a sheet, a second heating rotator and a second pressing rotator forming a heating nip heating the fixed toner image on the predetermined sheet that has passed through the fixing nip, a first rubbing member keeping a range of the first heating rotator contactable with the sheet at a predetermined surface roughness by rubbing a surface of the first heating rotator, and a second rubbing member keeping a range of the second heating rotator contactable with the sheet at a surface roughness smaller than the predetermined surface roughness by rubbing a surface of the second heating rotator.

22 Claims, 24 Drawing Sheets

FIG. 4

| RECORDING MEMBER | RANGE OF BASIS WEIGHT RANGE [g/m$^2$] | FIXING APPARATUS | |
|---|---|---|---|
| | | FIRST | SECOND |
| PLAIN SHEET | ~150 | 150°C | – |
| | 151~256 | 170°C | 150°C |
| | 257~ | 170°C | 180°C |
| MATT COATED SHEET | ~150 | 150°C | 150°C |
| | 151~256 | 170°C | 150°C |
| | 257~ | 170°C | 180°C |
| GLOSS COATED SHEET | ~150 | 150°C | 150°C |
| | 151~256 | 170°C | 150°C |
| | 257~ | 170°C | 180°C |

FIG. 9

| TYPE OF SHEET | BRAND | BASIS WEIGHT [g/m $^2$] | THICKNESS [μm] | BEKK SMOOTHNESS [sec] | HEIGHT OF BURR [μm] |
|---|---|---|---|---|---|
| PLAIN SHEET 1 | GF -640 | 64 | 85 | 40 | 1.0 |
| PLAIN SHEET 2 | GF -C081 | 81 | 100 | 80 | 1.5 |
| PLAIN SHEET 3 | GF -C209 | 209 | 230 | 70 | 6.0 |
| PLAIN SHEET 4 | Hammermil ColorCopy | 216 | 240 | 100 | 13.0 |
| PLAIN SHEET 5 | UPM Fine | 300 | 340 | 20 | 6.0 |
| COATED SHEET 1 | OK TOP COAT+ | 85 | 70 | 1000 | 0.2 |
| COATED SHEET 2 | MIRROR COAT P | 256 | 270 | 300 | 0.5 |
| COATED SHEET 3 | UPM Finesse Gloss | 300 | 320 | 500 | 1.0 |
| COATED SHEET 4 | UPM Finesse Silk | 300 | 310 | 100 | 1.0 |

FIG. 14

| | LOWER LIMIT | UPPER LIMIT |
|---|---|---|
| FIRST FIXING APPARATUS | GLOSS LEVEL DIFFERENCE IS GENERATED (COBA FLAW) BY DIFFERENCE BETWEEN ROUGHNESS OF COBA PART AND ROUGHNESS OF PARTS OTHER THAN COBA PART | GLOSSINESS OF PLAIN SHEET DROPS, DETERIORATION OF HOT OFFSET |
| SECOND FIXING APPARATUS | GLOSS LEVEL DIFFERENCE IS GENERATED (COBA FLAW) BY DIFFERENCE BETWEEN ROUGHNESS OF COBA PART AND ROUGHNESS OF PARTS OTHER THAN COBA PART, FINE FLAWS ON SURFACE OF FIXING ROLLER MANIFEST | GLOSSINESS AND IMAGABILITY OF GLOSS COATED SHEET DROPS, GLOSS LEVEL DIFFERENCE BETWEEN SHEET FEEDING PART AND NON-SHEET FEEDING PART DETERIORATES |

FIG. 15

| | COBA FLAW | RUBBING FLAW | IMAGE QUALITY |
|---|---|---|---|
| FIRST COMPARATIVE EXAMPLE | × | ○ | ○ |
| SECOND COMPARATIVE EXAMPLE | ○ | △ | ○ |
| FIRST EXAMPLE | ○ | ○ | ○ |
| SECOND EXAMPLE | ○ | ○ | ○ |
| THIRD EXAMPLE | ○ | ○ | ○ |
| THIRD COMPARATIVE EXAMPLE | △ | ○ | ○ |
| FOURTH COMPARATIVE EXAMPLE | ○ | ○ | △ |

FIG. 21

| RECORDING MEDIUM | RANGE OF BASIS WEIGHT [g/m$^2$] | THRESHOLD VALUE OF RUBBING OPERATION | |
|---|---|---|---|
| | | C1max | C2max |
| PLAIN SHEET | ~150 | 500 | – |
| | 151~256 | 1000 | 500 |
| | 257~ | 500 | 500 |
| MATT COATED SHEET | ~150 | 1000 | 1000 |
| | 151~256 | 1000 | 1000 |
| | 257~ | 1000 | 500 |
| GLOSS COATED SHEET | ~150 | 1000 | 500 |
| | 151~256 | 500 | 500 |
| | 257~ | 500 | 250 |

FIG. 22

| FIXING APPARATUS | SETTING | REFRESHING PRESSURE | ABRASIVE PARTICLE SIZE NO. | FREQUENCY | DEPTH OF FLAW |
|---|---|---|---|---|---|
| FIRST FIXING APPARATUS | - | 8kgf | #2000 | NORMAL | 1.5 μm |
| | THIRD COMPARATIVE EXAMPLE | 4kgf | #2000 | NORMAL | 1.0 μm |
| SECOND FIXING APPARATUS | FIRST COMPARATIVE EXAMPLE | — | — | NONE | 0.5 μm |
| | SECOND COMPARATIVE EXAMPLE | 8kgf | #2000 | NORMAL | 1.5 μm |
| | FIRST EXAMPLE | 8kgf | #3000 | NORMAL | 1.0 μm |
| | SECOND EXAMPLE | 8kgf | #2000 | HALF | 1.0 μm |
| | THIRD EXAMPLE | 4kgf | #2000 | NORMAL | 1.0 μm |
| | THIRD COMPARATIVE EXAMPLE | 4kgf | #2000 | NORMAL | 1.0 μm |
| | FOURTH COMPARATIVE EXAMPLE | 4kgf | #800 | (DRIVEN) | 1.5 μm |

FIG. 24

| RECORDING MEDIUM | RANGE OF BASIS WEIGHT [g/m$^2$] | FIXING APPARATUS | | THRESHOLD VALUE OF RUBBING OPERATION | |
|---|---|---|---|---|---|
| | | FIRST | SECOND | C1max | C2max |
| PLAIN SHEET | ~150 | 150°C | – | 500 | – |
| | 151~256 | 170°C | 150°C | 500 | 1000 |
| | 257~ | 170°C | 180°C | 500 | 1000 |
| MATT COATED SHEET | ~150 | 150°C | 150°C | 1000 | 2000 |
| | 151~256 | 170°C | 150°C | 1000 | 2000 |
| | 257~ | 170°C | 180°C | 1000 | 2000 |
| GLOSS COATED SHEET | ~150 | 150°C | 150°C | 1000 | 2000 |
| | 151~256 | 170°C | 150°C | 500 | 1000 |
| | 257~ | 170°C | 180°C | 500 | 1000 |

IMAGE FORMING APPARATUS

BACKGROUND OF THE INVENTION

1. Field of the Invention

The present invention relates to an image forming apparatus such as a copier, a printer, a facsimile, and a multi-function printer including a plurality of the functions, and more specifically to a configuration thereof including a plurality of fixing apparatuses fixing a toner image on a sheet.

2. Description of the Related Art

Hitherto, an image forming apparatus adopting an electrophotographic system or the like is configured to fix a toner image onto a sheet on which the toner image has been formed by heating and pressing the sheet in passing through a nip between a fixing roller and a pressure roller composing a fixing apparatus.

Because the surface roughness of the fixing roller affects the quality of the image formed on the sheet in such an image forming apparatus, an arrangement is made to roughen the surface of the fixing roller by a roughening roller to keep desirable surface roughness as disclosed in Japanese Patent Application Laid-open No. 2008-40363. Japanese Patent Application Laid-open No. 2008-40363 proposes to roughen the surface of the fixing roller to the desirable roughness by bringing the roughening roller rotated at a surface moving speed different from a surface moving speed of the fixing roller into contact with the fixing roller to imprint fine flaws on the surface of the fixing roller.

Japanese Patent Application Laid-open No. 2008-40363 restrains streaky gloss unevenness from being generated on an output image by widthwise both edge parts (referred to as 'coba parts' hereinafter) of a sheet passing through the nip, even if streaky flaws are imprinted on the surface of the fixing roller by the coba parts, by roughening the surface of the fixing roller to the desirable surface roughness.

However, in the fixing apparatus configured to bring the roughening roller into contact with the surface of the fixing roller to restrain such gloss unevenness caused by the coba parts, the fine flaws imprinted on the surface of the fixing roller by the roughening roller possibly generate fine gloss unevenness on the output image. It is possible to make such fine gloss unevenness inconspicuous by refining the flaws imprinted on the surface of the fixing roller. However, it is hard to suppress the gloss unevenness from being generated due to the coba parts if the flaws imprinted on the surface of the fixing roller are further made finer. Accordingly, it is desirable for an image forming apparatus required to output a high quality image to be able to suppress a drop in quality of the output image by suppressing the generation of the fine gloss unevenness in addition to the gloss unevenness caused by the coba parts.

SUMMARY OF THE INVENTION

According to one aspect of the invention, an image forming apparatus of the invention includes an image forming portion forming a toner image on a sheet, a first heating rotator and a first pressing rotator forming a fixing nip fixing the non-fixed toner image formed in the image forming portion onto the sheet, a second heating rotator and a second pressing rotator forming a heating nip heating the fixed toner image on a predetermined sheet that has passed through the fixing nip a first rubbing member rubbing a range of a surface of the first heating rotator contactable with the sheet, and a first contact/separate portion bringing the first rubbing member into contact with and keeping the first rubbing member away from the first heating rotator. The first contact/separate portion brings the first rubbing member into contact with the first heating rotator in executing a first roughening process on the first heating rotator. The apparatus also includes a second rubbing member rubbing a range of a surface of the second heating rotator contactable with the sheet, and a second contact/separate portion bringing the second rubbing member into contact with and keeping the second rubbing member away from the second heating rotator. The second contact/separate portion brings the second rubbing member into contact with the second heating rotator in executing a second roughening process on the second heating rotator. The surface roughness of the second heating rotator to which the second roughening process has been executed is smaller than the surface roughness of the first heating rotator on which the first roughening process has been executed.

According to another aspect of the invention, an image forming apparatus includes an image forming portion forming a toner image on a sheet, a first heating rotator and a first pressing rotator forming a fixing nip fixing the non-fixed toner image formed in the image forming portion onto the sheet, a second heating rotator and a second pressing rotator forming a heating nip heating the fixed toner image on a predetermined sheet that has passed through the fixing nip, a first rubbing member keeping a range of the first heating rotator contactable with the sheet at a predetermined surface roughness by rubbing a surface of the first heating rotator, and a second rubbing member keeping a range of the second heating rotator contactable with the sheet at a surface roughness smaller than the predetermined surface roughness by rubbing a surface of the second heating rotator.

According to a still other aspect of the invention, an image forming apparatus includes an image forming portion forming a toner image on a sheet, a first heating rotator and a first pressing rotator forming a fixing nip fixing the non-fixed toner image formed in the image forming portion onto the sheet, a second heating rotator and a second pressing rotator forming a heating nip heating the fixed toner image on a predetermined sheet that has passed through the fixing nip, a first rubbing member rubbing a range of a surface of the first heating rotator contactable with the sheet, and a first contact/separate portion bringing the first rubbing member into contact with and keeping the first rubbing member away from the first heating rotator. The first contact/separate portion brings the first rubbing member into contact with the first heating rotator in executing a first roughening process on the first heating rotator. The apparatus also includes a second rubbing member rubbing a range of a surface of the second heating rotator contactable with the sheet, and a second contact/separate portion bringing the second rubbing member into contact with and keeping the second rubbing member away from the second heating rotator. The second contact/separate portion brings the second rubbing member into contact with the second heating rotator in executing a second roughening process on the second heating rotator. The apparatus further includes a control portion controlling the first contact/separate portion to execute the first roughening process on the first heating rotator in a case when the number of predetermined sheets passing through the fixing nip counted in performing image forming operations consecutively on a plurality of predetermined sheets has become a first value and controlling the second contact/separate portion to execute the second roughening process on the second heating rotator in a case when the number of the predetermined sheets counted in passing through the heating nip becomes a second value which is greater than the first value.

Further features of the present invention will become apparent from the following description of exemplary embodiments with reference to the attached drawings.

BRIEF DESCRIPTION OF THE DRAWINGS

FIG. 4 is a table showing the heating temperature per each sheet of the first and second fixing apparatuses of the first embodiment.

FIG. 9 is a table showing specifications of the sheets of the first embodiment.

FIG. 14 is a table illustrating upper and lower limits of the surface roughnesses of the first and second heating rotators of the first embodiment.

FIG. 15 is a table showing the conditions of images formed on sheets by image forming apparatuses of respective embodiments.

FIG. 21 is a table showing relationships between types of sheets and rubbing operation threshold values in the image forming apparatus of the first embodiment.

FIG. 22 is a table showing rubbing conditions in the image forming apparatus of the first embodiment.

FIG. 24 is a table showing relationships between types of sheets and fixing temperatures and rubbing operation threshold values corresponding to the respective sheets in the image forming apparatus of a second embodiment.

DESCRIPTION OF THE EMBODIMENTS

First Embodiment

A first embodiment of the invention will be described with reference to FIGS. 1 through 23. Firstly, a configuration of an image forming apparatus 100 of the embodiment will be schematically described with reference to FIG. 1. It is noted that the image forming apparatus 100 of the present embodiment is applicable to a copier, a printer, a facsimile, and a multi-function printer including a plurality of functions of those devices.

[Image Forming Apparatus]

Figure 1:
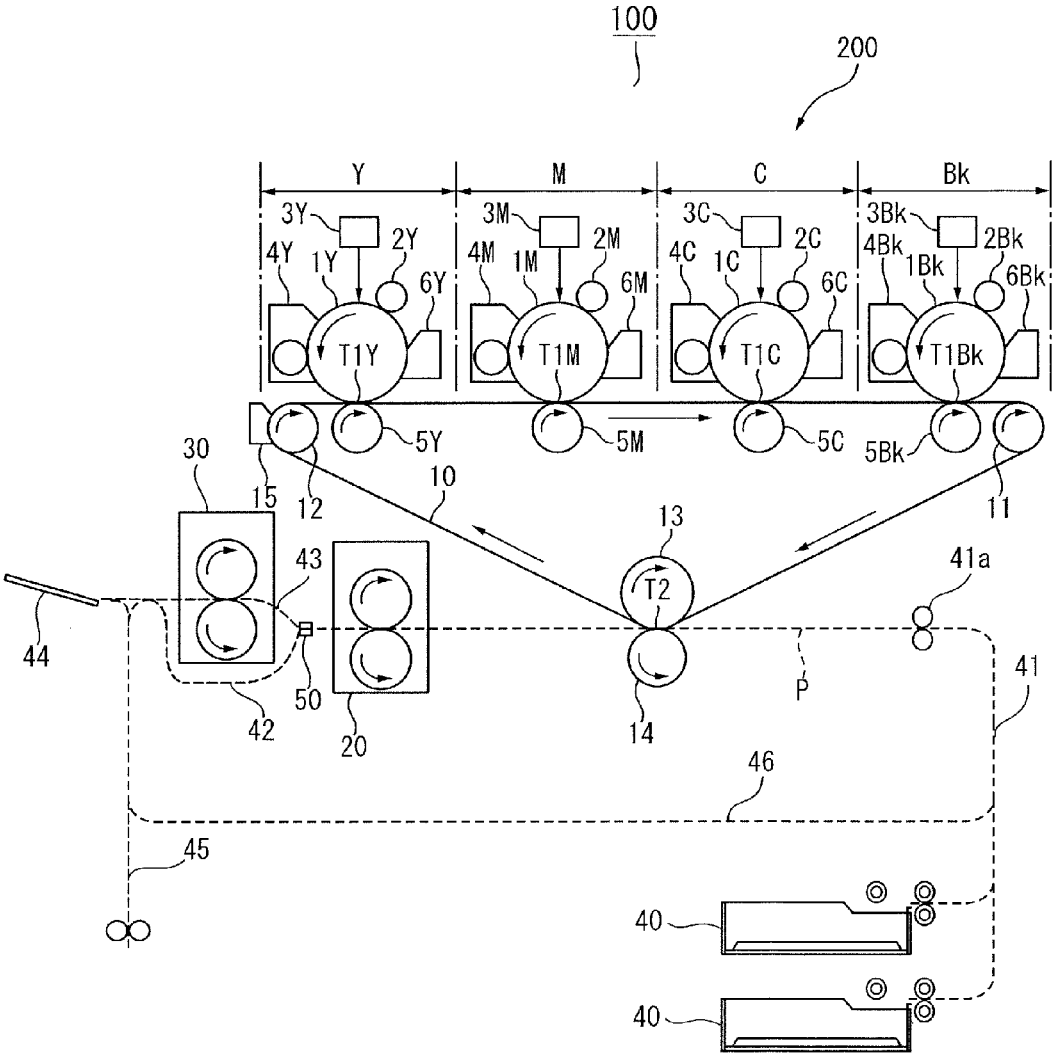
FIG. 1 is a schematic diagram illustrating a configuration of an image forming apparatus of a first embodiment of the invention.

The image forming apparatus 100 shown in FIG. 1 is a full-color image forming apparatus using an electro-photographic system and includes four image forming units Y (yellow), M (magenta), C (cyan), and Bk (black) respectively forming toner images of four different colors. Disposed adjacent these image forming units is an endless intermediate transfer belt 10, i.e., an intermediate transfer body, onto which the respective color toner images which have been formed in the respective image forming units are transferred. These four image forming units Y, M, C, and Bk have the same configuration, so that the configuration of the yellow image forming unit Y will be typically described below. The same or corresponding configurations and operational members of the other image forming units with those of the yellow image forming unit Y will be denoted by the same reference numerals while only changing subscripts indicating each unit.

A cylindrical electro-photosensitive body 1Y (referred to as a 'photosensitive drum' hereinafter), i.e., an image carrier, whose surface layer is made of organic photo-semiconductor, is rotationally driven in a direction of an arrow in FIG. 1. A charging roller 2Y, i.e., an electrifying member, homogeneously electrifies the surface of the photosensitive drum 1Y. That is, the charging roller 2Y to which a predetermined bias is applied electrifies the surface of the photosensitive drum 1Y with predetermined potential by being in contact with and rotated by the photosensitive drum 1Y. The electrified photosensitive drum 1Y is exposed by exposure light, e.g., laser light, by an exposure unit 3Y, and an electrostatic latent image corresponding to a color separation image of image data inputted from a scanner or an external terminal is formed on the surface of the photosensitive drum 1Y. A developing unit 4Y develops the electrostatic latent image by using toner carried on a developing sleeve thereof to form a toner image corresponding to the electrostatic latent image on the surface of the photosensitive drum 1Y. Since primary transfer bias is applied to a primary transfer roller 5Y, the toner image on the photosensitive drum 1Y is primarily transferred onto the intermediate transfer belt 10 at a primary transfer nip portion T1Y between the photosensitive drum 1Y and the intermediate transfer belt 10.

Primary transfer residual toner left on the photosensitive drum 1Y after the primary transfer is removed and recovered by a photosensitive drum cleaning unit 6Y provided with a blade, a brush or the like. Then, the photosensitive drum 1Y from which the primary transfer residual toner has been removed is homogeneously and uniformly electrified by the charging roller 2Y to be used to repeatedly form an image. The intermediate transfer belt 10 is stretched by a driving roller 11, a supporting roller 12, and a backup roller 13. Then, the intermediate transfer belt 10 is rotationally driven by the driving roller 11 in a rotation direction thereof while in contact with the photosensitive drums 1Y, 1M, 1C, and 1Bk of the four image forming units Y, M, C, and Bk.

When an image forming job of a full-color mode (full-color image forming job) is inputted to the image forming apparatus 100, the image forming operations as described above are executed in each of the four image forming units Y, M, C, and Bk. Then, the yellow, magenta, cyan, and black toner images formed respectively on the photosensitive drums 1Y, 1M, 1C, and 1Bk are sequentially superimposed and transferred onto the intermediate transfer belt 10. It is noted that the order of the colors is not limited to what described above and is arbitrary depending on the image forming apparatus.

The four color toner images superimposed and transferred onto the intermediate transfer belt 10 are conveyed to a secondary transfer portion T2 where the backup roller 13 and a secondary transfer roller 14 are disposed to face with each other while interposing the intermediate transfer belt 10 therebetween. Then, the toner images are collectively and secondarily transferred to a sheet P by the secondary transfer roller 14 to which secondary transfer bias is applied at the secondary transfer portion T2. The sheet P is a sheet member, such as a sheet of paper and an OHP sheet, and is stored in a plurality of sheet feed cassettes 40 respectively in accordance with the types of the sheets. Then, the sheet P is taken out of either one of the plurality of cassettes 40 while being separated one by one by a feeding unit 41 including a registration roller pair 41*a*. Then, the sheet P is supplied to the secondary transfer portion T2 by the registration roller pair 41*a* in synchronism with the toner image on the intermediate transfer belt 10. Here, the image forming apparatus 100 conveys the sheet P stored in either one of the plurality of sheet feed cassettes 40 selected by a CPU 400 (see FIG. 5) in response to printing conditions (image forming conditions) for example by the feeding unit 41. It is noted that the printing conditions are conditions set based on various information such as the color number, whether an image to be formed on the sheet P is color or monochrome, and the sheet type of the sheet P. It is noted that the image forming apparatus 100 may be configured to form an image on an arbitrary sheet selected by a user regardless of such printing conditions (image forming conditions).

An image forming portion 200 forming an image on the sheet P is constructed as described above in the present embodiment. Then, the image (toner image) formed on the sheet P by such image forming portion unit 200, i.e., the toner image transferred onto the sheet P at the secondary transfer portion T2, is conveyed to a plurality of fixing apparatuses to be fixed onto the sheet P in the present embodiment. That is, according to the present embodiment, the sheet P on which the toner image has been transferred is led to a first fixing apparatus 20 provided upstream in a sheet conveying direction of the secondary portion T2 so that the non-fixed toner image on the sheet P is heated and pressed to be fixed onto the sheet P.

Secondary transfer residual toner left on the intermediate transfer belt 10 after the second transfer is removed and recovered by an intermediate transfer belt cleaning unit 15 including a blade, a brush, or a web (nonwoven cloth). The intermediate transfer belt 10 from which the secondary transfer residual toner has been removed is used again repeatedly to form an image.

The image forming apparatus 100 also includes a first conveying route 42 through which the sheet P passes to only the first fixing apparatus 20 and a second conveying route 43 through which the sheet P passes to the first fixing apparatus 20 and a second fixing apparatus 30. That is, the sheet P on which the toner image has been fixed is conveyed through either one of the first conveying route 42 and the second conveying route 43. Here, the CPU 400 serving as a conveying route determining portion, determines the first conveying route 42 or the second conveying route 43 as a conveying route of the sheet P corresponding to the type of the sheet P. After determining the first conveying route 42 or the second conveying route 43 as a passage of the sheet P, the CPU 400 drives a driving member 50, i.e., conveying route setting member, to block an entrance of the conveying route through which the sheet P is not passed. The image forming apparatus 100 can pass the sheet P through the conveying route determined by the CPU 400 by blocking the entrance. A detailed configuration for changing the conveying route based on the type of the sheet P will be described later.

In a case when the sheet P passes through the second conveying route 43, the sheet P is conveyed also to the second fixing apparatus 30 provided downstream, in the sheet conveying direction, of the first fixing apparatus 20. Then, the sheet P is heated and pressed again at the second fixing apparatus 30, so that the toner image which has been fixed onto the sheet P melts again, is softened, and is fixed again onto the sheet P. In a case of forming an image on one side of the sheet P, the sheet P is discharged to a discharge tray 44 after passing through the first conveying route 42 or the second conveying route 43. In a case of forming images on both sides of the sheet P, the image forming apparatus 100 reverses the sheet P onto which the toner image has been fixed by passing through a reversing path 45 and then conveys the sheet P again to the secondary transfer portion T2 through a duplex conveying path 46. After that, a toner image is fixed on a back side of the sheet P through the same processes as described above.

[First Fixing Apparatus]

Figure 2:
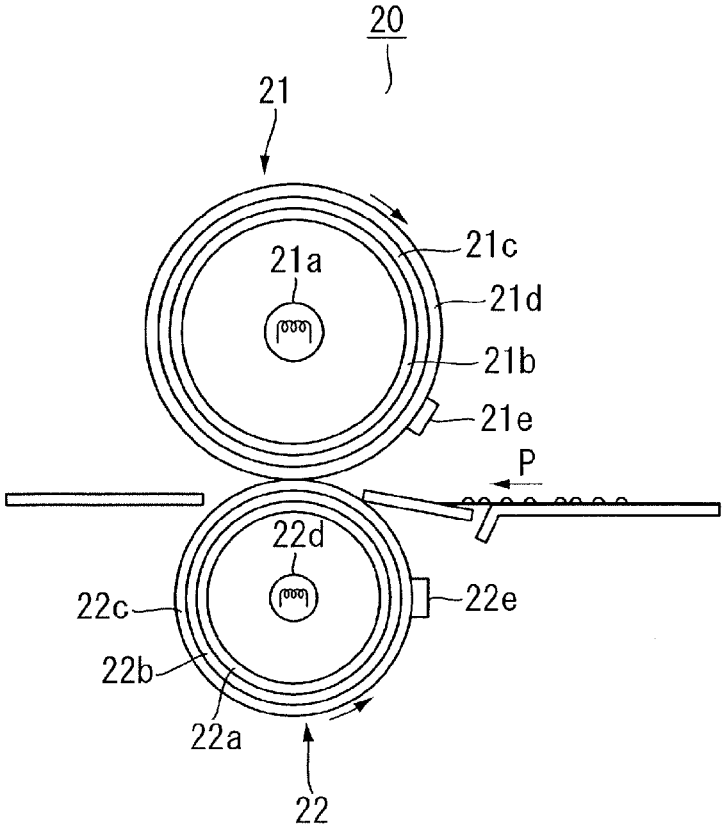
FIG. 2 is a schematic section view illustrating a configuration of a first fixing apparatus of the first embodiment.
Figure 3:
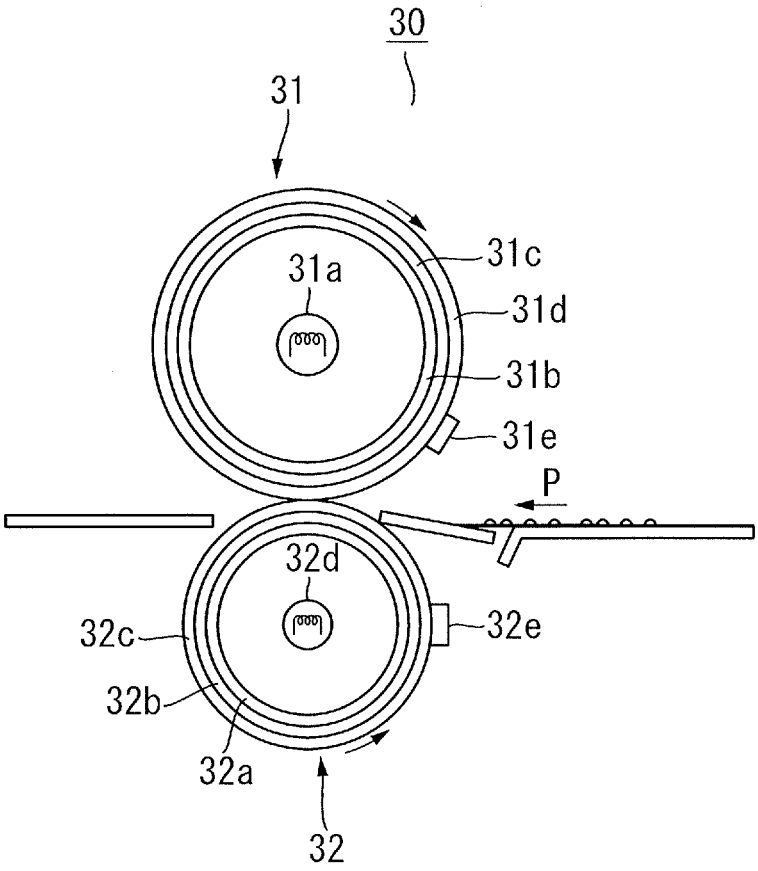
FIG. 3 is a schematic section view illustrating a configuration of a second fixing apparatus of the first embodiment.

FIG. 2 is a section view illustrating a configuration of the first fixing apparatus 20 of the present embodiment, and FIG. 3 is a section view illustrating a configuration of the second fixing apparatus 30 of the present embodiment. It is noted that refresh rollers 23 and 33 described later are omitted in FIGS. 2 and 3. The image forming apparatus 100 adopts a tandem fixing system in which a plurality of, i.e., two or more, fixing apparatuses is disposed in series in the sheet conveying direction. In the present embodiment, the image forming apparatus 100 includes the first and second fixing apparatuses 20 and 30 as described later. The image forming apparatus 100 uses a toner containing release agent, and the first and second fixing apparatuses 20 and 30 are both oilless fixing apparatuses.

The first fixing apparatus 20 includes a fixing roller 21, i.e., a rotatable heating rotator (first heating rotator) in contact with and heating the surface of the sheet P on which the toner image has been formed. The first fixing apparatus 20 also includes a pressure roller 22, i.e., a rotable nip forming member (pressure rotator, first pressure rotator) in contact with the fixing roller 21 and forming a first fixing nip N1 with the fixing roller 21. In the first fixing apparatus 20, the fixing roller 21 is heated by a heat source 21*a*, i.e., a first heat source, provided therein. Then, the first fixing apparatus 20 heats and presses the sheet P carrying the toner image and melts the toner image to fix the toner onto the sheet P while nipping and conveying the sheet P through the first fixing nip N1. The heat source 21*a* is a halogen heater, for example, and the turning on and off of the power is controlled by the CPU 400 (see FIG. 5) serving as a heat source control portion. For instance, the CPU 400 controls the heat source 21*a* such that the surface temperature of the fixing roller 21 is kept at a predetermined temperature based on the surface temperature of the fixing roller 21 detected by a temperature sensor 21*e*, i.e., a first temperature detecting member.

That is, in the present embodiment, the heat source 21*a* heats the fixing roller 21 so that the surface of the fixing roller 21 is kept at the predetermined temperature, e.g., around 150 to 180° C., suitable for fixing the toner image onto the sheet P. Here, the suitable temperature for fixing the toner image onto the sheet P is different depending on types or the like of the sheet P. To that end, the CPU 400 controls the heat source 21*a* such that the surface temperature of the fixing roller 21 varies depending on the type and a basis weight of the sheet P as shown in Table in FIG. 4. It is noted that the basis weight is weight (g/m$^2$) of a sheet per 1 m$^2$. Still further, although the heat source 21*a* is provided within the fixing roller 21 in the present embodiment, the present invention is not limited to such a configuration. For instance, the fixing apparatus may be configured such that the fixing roller 21 is heated from the outside. While the heat source 21*a* is composed of the halogen heater in the present embodiment, the present invention is also not limited also to such a configuration. For instance, the heater may be any heater as long as it can heat the fixing roller 21, such as an inductive heating device.

As shown in FIG. 2, the fixing roller 21 is constructed by providing an elastic layer 21*c* formed of a rubber layer on a hollow metallic core shaft 21*b*, i.e., a base layer, and by covering the elastic layer 21*c* with a releasing layer 21*d*, i.e., a surface layer, on the elastic layer 21*c*. The core shaft 21*b* is formed of an aluminum member formed into a cylindrical shape of 68 mm of outer diameter, for example, and includes the heat source 21*a* therein. The elastic layer 21*c* is molded into a layer of 1.0 mm thick by silicon rubber of 20 degree of JIS-A hardness, for example. The releasing layer 21*d* is composed of a material that excels in releasability and is softened by an increase of temperature such as fluororesin molded into a layer of 50 μm thick for example and covers the elastic layer 21*c*. It is noted that for the releasing layer 21*d*, PFA resin (copolymer of polytetrafluoroethylene and par fluoroalkoxy-fluoroethylene), PTFE (polytetrafluoroethylene), or the like is used, for example, as the fluororesin. A PFA resin tube was used as the releasing layer 21*d* in the present embodiment. The thickness of the releasing layer 21*d*, i.e., the surface layer of the fixing roller 21, is preferable to be 30 to 100 μm for example. Here, the releasing layer 21*d* is not limited to be a tube and may cover the elastic layer 21*c* by coating the elastic layer 21*c* for example.

Figure 5:
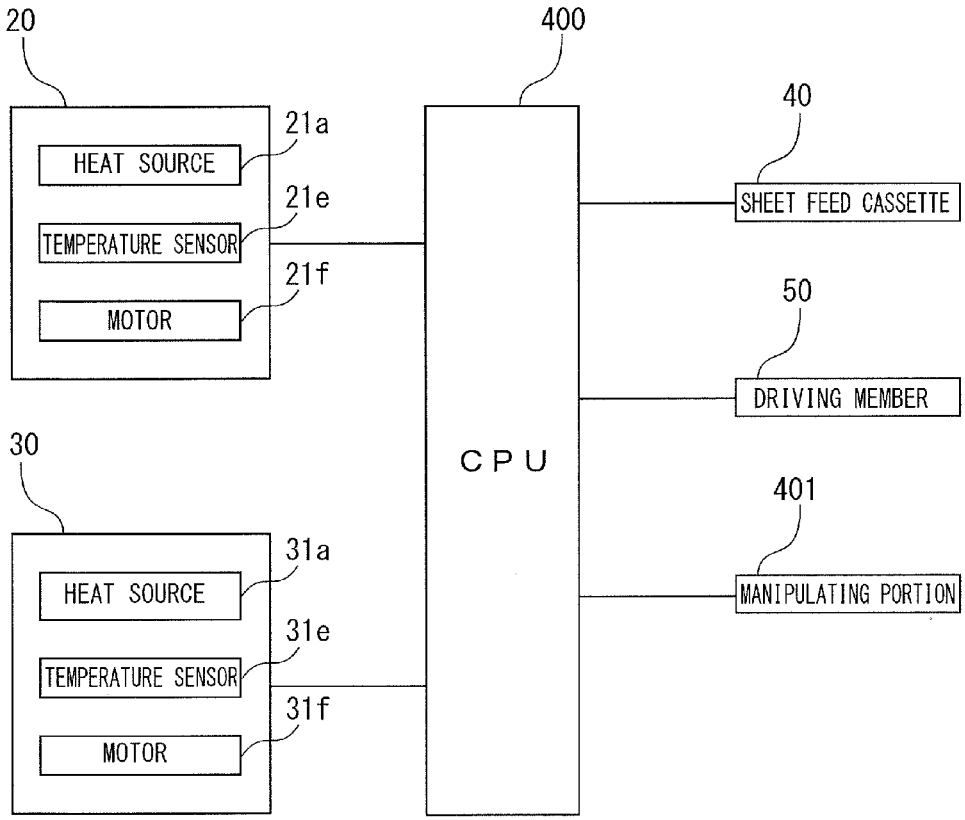
FIG. 5 is a control block diagram of the image forming apparatus of the first embodiment.

The fixing roller 21 is rotatably supported by supporting members (not shown) provided at both ends in a longitudinal direction (rotation axial line direction) of the core shaft 21*b* and is rotationally driven in a direction of an arrow in FIG. 2 by a motor 21*f* (see FIG. 5). The fixing roller 21 is rotationally driven by the motor 21*f* with a surface moving speed of 100 mm/sec., for example. It is noted that the surface moving speed of each rotator will be referred to also as the 'circumferential speed' in the following description.

As shown in FIG. 2, the pressure roller 22 is constructed by providing an elastic layer 22*b*, formed of a rubber layer, on a hollow metallic core shaft 22*a*, i.e., a base layer, and by covering the elastic layer 22*b* with a releasing layer 22*c*, i.e., a surface layer, on the elastic layer 22*b*. The core shaft 22*a* is formed of an aluminum member formed into a cylindrical shape of 48 mm of outer diameter, for example. The elastic layer 22*b* is molded into a layer of 2.0 mm thick by silicon rubber of 20 degree of JIS-A hardness, for example. The releasing layer 22*c* is composed of a material that excels in releasability, such as fluororesin, molded into a layer of 50 μm thick, for example and covers the elastic layer 22*b*. Here, the material of the releasing layer 22*c* and the structure covering the elastic layer 22*b* are not limited to the configurations of the present embodiment, similarly to the releasing layer 21*d* of the fixing roller 21. A heat source 22*d* such as a halogen heater is disposed within the pressure roller 22. The CPU 400 serving as the heat source control portion, controls the turning on and off of power to the heat source 22*d*, based on the surface temperature of the pressure roller 22 detected by a temperature sensor 22*e*.

The pressure roller 22 is rotably supported by supporting members (not shown) provided at both ends in a longitudinal direction (rotation axial line direction) of the core shaft 22*a*. The supporting members at the both ends in the longitudinal direction of the pressure roller 22 are biased toward the fixing roller 21, respectively, by pressure springs (not shown), i.e., bias members, so that the pressure roller 22 forms the first fixing nip N1 of a predetermined width in the sheet conveying direction with the fixing roller 21. The pressure roller 22 is driven and rotated by the fixing roller 21 by being in contact with the fixing roller 21. In the present embodiment, the pressure roller 22 is pressed against the fixing roller 21 with a total pressure of 400 N for example. Still further, the width (length in the sheet conveying direction) of the first fixing nip N1 is arranged to be wider than the width (length in the sheet conveying direction) of a second heating nip N2 of the second fixing apparatus 30, as described later. This arrangement makes it possible for the image forming apparatus 100 to improve the conveying speed of the sheet P in the first fixing apparatus 20 and to form an image in a short time.

[Second Fixing Apparatus]

FIG. 3 is a section view illustrating a configuration of the second fixing apparatus 30. In the present embodiment, components configuring the second fixing apparatus 30 and having the same configurations and operations as those of the first fixing apparatus 20 will be denoted by the same reference numerals, and their explanation will be omitted.

The second fixing apparatus 30 is disposed downstream in the sheet conveying direction of the first fixing apparatus 20. The second fixing apparatus 30 includes a fixing roller 31, i.e., a rotable heating rotator (second heating rotator) in contact with and heating the surface of the sheet P on which the toner image has been formed. The second fixing apparatus 30 also includes a pressure roller 32, i.e., a rotable nip forming member (pressure rotator, second pressure rotator) in contact with the fixing roller 31 and forming a second heating nip N2 with the fixing roller 31. In the second fixing apparatus 30, the fixing roller 31 is heated by a heat source 31*a*, i.e., a second heat source, provided therein. Then, the second fixing apparatus 30 heats and presses the sheet P carrying the toner image and melts the toner image again to fix onto the sheet P while nipping and conveying the sheet P through the second heating nip N2.

The heat source 31*a* is a halogen heater, for example, and the turning on and off of the power to the heat source 31*a* is controlled by the CPU 400, serving as the heat source control portion. For instance, the CPU 400 controls the heat source 31*a* so that the surface temperature of the fixing roller 31 is kept at a predetermined temperature based on the surface temperature of the fixing roller 31 detected by a temperature sensor 31*e*, i.e., a second temperature detecting member.

Here, the suitable temperature for applying favorable glossiness to the toner image on the sheet P is different, depending on the type or the like of the sheet P. To that end, the CPU 400 controls the heat source 31*a* such that the surface temperature of the fixing roller 31 varies, depending on the type and the basis weight of the sheet P as shown in Table in FIG. 4. It is noted that similarly to the heat source 21*a*, the position and configuration of the heat source 31*a* are not specifically limited as long as the heat source 31*a* is configured to be controlled by the CPU 400 and to be able to heat the fixing roller 31.

As shown in FIG. 3, the fixing roller 31 is constructed by providing an elastic layer 31*c* formed of a rubber layer on a hollow metallic core shaft 31*b*, i.e., a base layer, and by covering the elastic layer 31*c* with a releasing layer 31*d*, i.e., a surface layer, on the elastic layer 31*c*. The releasing layer 31*d* is composed of a material that excels in releasability and is softened by an increase of temperature, such as fluororesin molded into a layer of 50 μm thick, for example, and covers the elastic layer 31*c*. It is noted that for the releasing layer 31*d*, PFA resin (copolymer of polytetrafluoroethylene and par fluoroalkoxyfluoroethylene), PTFE (polytetrafluoroethylene), or the like is used, for example, as the fluororesin. A PFA resin tube was used as the releasing layer 31*d* in the present embodiment. The thickness of the releasing layer 31*d*, i.e., the surface layer of the fixing roller 31, is preferable to be 30 to 100 μm, for example. Here, the releasing layer 31*d* is not limited to be a tube and may cover the elastic layer 31*c* by coating the elastic layer 31*c*, for example.

The fixing roller 31 is rotably supported by supporting members (not shown) provided at both ends in the longitudinal direction (rotation axial line direction) of the core shaft 21*b* and is rotationally driven in a direction of an arrow in FIG. 3 by a motor 31*f* (see FIG. 5). The fixing roller 31 is rotationally driven by the motor 31*f* with a circumferential speed of 100 mm/sec., for example.

As shown in FIG. 3, the pressure roller 32 is constructed by providing an elastic layer 32*b* formed of a rubber layer on a hollow metallic core shaft 32*a*, i.e., a base layer, and by covering the elastic layer 32*b* with a releasing layer 32*c*, i.e., a surface layer, on the elastic layer 32*b*. The elastic layer 32*b* is molded into a layer of 1.0 mm thick by silicon rubber of 20 degree of JIS-A hardness, for example. The pressure roller 32 also includes a heat source 32*d*, such as a halogen heater therein. The CPU 400, the heat source control portion, controls the heat source 32*d* based on the surface temperature of the pressure roller 32 detected by a temperature sensor 32*e*.

The pressure roller 32 is rotably supported by supporting members (not shown) provided at both ends in a longitudinal direction (rotation axial line direction) of the core shaft 32*a*. The supporting members at the both ends in the longitudinal direction of the pressure roller 32 are biased toward the fixing roller 31, respectively, by pressure springs (not shown), i.e., bias members, so that the pressure roller 32 forms a second heating nip N2 of a predetermined width in the sheet conveying direction with the fixing roller 31. The pressure roller 32 is driven and rotated by the fixing roller 31 by being in contact with the fixing roller 31. In the present embodiment, the pressure roller 32 is pressed against the fixing roller 31 with a total pressure of 300 N for example.

Here, the image forming apparatus 100 adopting the tandem fixing system fixes the toner image onto the sheet by the upstream fixing apparatus upstream in the sheet conveying direction and then executes fixation again by the most downstream fixing apparatus most downstream in the sheet conveying direction. As a result, the image forming apparatus 100 of the tandem fixing system improves fixability of the toner image onto the sheet and glossiness of the surface of the image.

In the image forming apparatus including the two or more, i.e., a plurality of, fixing apparatuses, the function of the most downstream fixing apparatus most downstream in the sheet conveying direction among the plurality of fixing apparatuses disposed along the sheet conveying direction is different from that of the upstream fixing apparatus provided upstream in the sheet conveying direction. Specifically, the most downstream fixing apparatus provided most downstream in the sheet conveying direction is provided to improve the glossiness of the image surface. The fixing apparatus provided upstream in the sheet conveying direction is provided to fix the toner image onto the sheet.

Therefore, the second fixing apparatus 30 of the present embodiment forms the second heating nip N2 with pressure different from that of the first fixing apparatus 20 such that it is suitable to remelt the toner image which has been fixed onto the sheet P and to fix again onto the sheet P.

According to the present embodiment, the most downstream second fixing apparatus 30 provided most downstream in the sheet conveying direction is configured such that the width of the second heating nip N2 is narrower than the width of the first fixing nip N1 of the first fixing apparatus 20 in order to improve the glossiness of the image. This arrangement makes it possible for the second fixing apparatus 30 to increase the linear load applied to the sheet P and to improve the glossiness of the image. Still further, because the toner image is melted and fixed again by the second fixing apparatus 30, the image forming apparatus 100 can smooth the surface of the image formed on the sheet P and can form the homogeneously glossy image onto the sheet P.

It is noted that although the image forming apparatus 100 includes one of the first fixing apparatus 20 and one of the second fixing apparatus 30 in the present embodiment, the present invention is not limited to such a configuration, and the image forming apparatus 100 may include a plurality of first fixing apparatuses 20. That is, the number of the first and second fixing apparatuses 20 and 30 is not specifically limited in the image forming apparatus 100 as long as the configuration of the first fixing apparatus 20 is different from that of the second fixing apparatus 30 provided downstream, in the sheet conveying direction, of the first fixing apparatus 20.

[Control Portion]

FIG. 5 is a block diagram illustrating a control portion provided in the image forming apparatus 100 of the present embodiment. As shown in FIG. 5, the CPU 400, i.e., the control portion, executing various controls of the image forming apparatus 100 is electrically connected to the first and second fixing apparatuses 20 and 30, respectively. Under the control of the CPU 400, the sheet conveying speeds and the surface temperatures of the fixing rollers 21 and 31 are controlled and the first and second fixing apparatuses 20 and 30 can fix and re-fix the toner image onto the sheet P.

The CPU 400 is also electrically connected with a sheet feed cassette 40 and a manipulating portion 401. In response to a selection of one cassette, made by the CPU 400, among a plurality of sheet feed cassettes 40 based on printing conditions or the like, the image forming apparatus 100 forms an image onto the sheet P stored in the sheet feed cassette 40 selected by the CPU 400. The manipulating portion 401 is composed of a liquid crystal touch panel, for example, and is manipulated by a user. It is noted that the manipulating portion 401 may be an external terminal, such as a personal computer, connected to the image forming apparatus 100.

The CPU 400 is also electrically connected with a driving member 50 that blocks the entrance to either one of the first and second conveying routes 42 and 43 determined by the CPU 400 not to pass the sheet P depending on the type of the sheet P. The image forming apparatus 100 can pass the sheet P through the conveying route determined by the CPU 400 by driving the driving member 50 depending on the type of the sheet P.

It is noted that in the present embodiment, the CPU 400 refers to a configuration including peripheral components, such as a ROM storing program information of various controls beside the CPU performing actual calculations. Still further, the control portion is not limited to be a configuration including a single CPU, but may be a configuration including a plurality of CPUs.

[Each Area of Fixing Roller]

Next, each longitudinal area of the fixing rollers 21 and 31 will be described with reference to FIGS. 6A and 6B. It is noted that each longitudinal area of the fixing rollers 21 and 31 is constructed in the same manner, so that it will be described by exemplifying the configuration of the fixing roller 21 in the following description. Still further, in the following description, the surfaces of the respective fixing rollers 21 and 31 comprise the releasing layers 21*d* and 31*d* constructed on the surface of the respective fixing rollers 21 and 31. That is, surface roughnesses of the respective fixing rollers 21 and 31 are synonymous with the surface roughnesses of the respective releasing layers 21*d* and 31*d*. Still further, in the following description, conveyance of the sheet P by the respective fixing rollers 21 and 31 is synonymous with fixation of the toner image onto the sheet P by the respective fixing rollers 21 and 31.

Figure 6A:
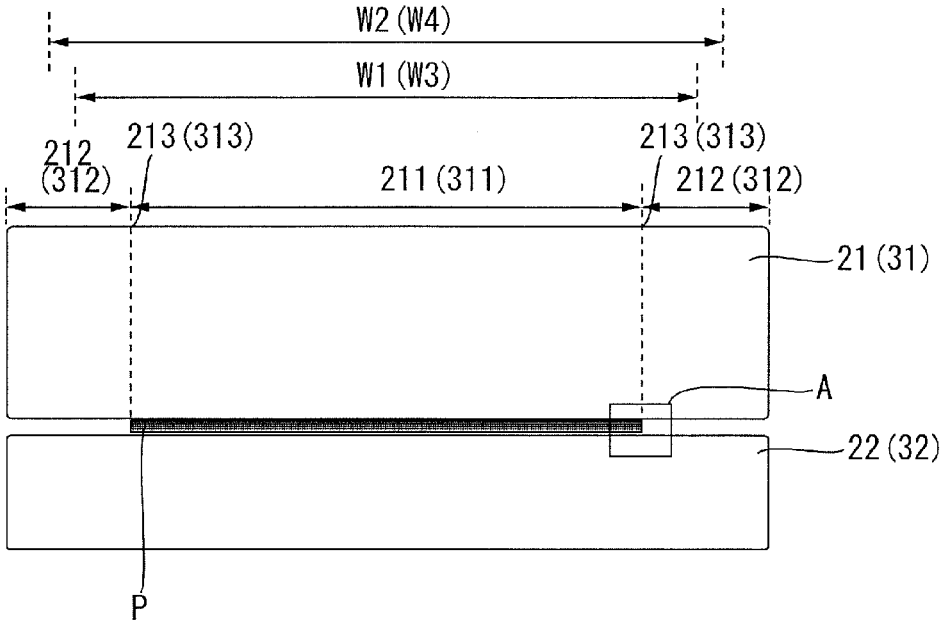
FIG. 6A is a schematic front view of a first heating rotator of the first embodiment.
Figure 6B:
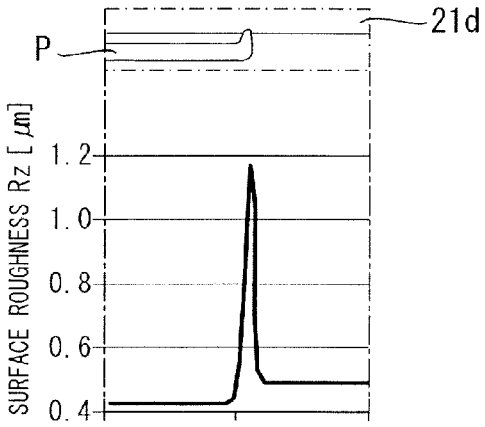
FIG. 6B is a graph showing the changes of the surface roughness of the first heating rotator at an area A in FIG. 6A.

As shown in FIG. 6A, the fixing roller 21 is includes, longitudinally, a passing part (sheet feeding part) 211 coming in contact with the sheet P at a longitudinal center part, non-passing parts (non-sheet feeding parts) 212 located longitudinally at the outsides and not coming into contact with the sheet P, and coba parts 213 located at boundaries between the passing part 211 and the non-passing parts 212. It is noted that the sheet used here is a sheet whose widthwise size is narrower than that of a sheet whose widthwise size usable in the image forming apparatus is a maximum. That is, the passing part 211 is narrower than an area where the maximum widthwise size sheet can carry the toner image, i.e., an area W1 through which the maximum size sheet can pass. In other words, the area W1 is an area where contact can be made with a non-fixed toner image within an area of the fixing roller 21. Still further, the area W1 is narrower than the area W2 through which the maximum widthwise size sheet P can pass.

It is noted that the same relationship of the fixing roller 21 applies also to the fixing roller 31. That is, the fixing roller 31 includes, longitudinally, a passing part (sheet feeding part) 311 coming into contact with the sheet P at a longitudinal center part, non-passing parts (non-sheet feeding parts) 312 located longitudinally at the outsides and not coming into contact with the sheet P, and coba parts 313 located at boundaries between the passing part 311 and the non-passing parts 312. It is noted that the sheet P used here is a sheet P whose widthwise size is narrower than a sheet P whose widthwise size usable in the image forming apparatus is a maximum. That is, the passing part 311 is narrower the area where the maximum widthwise size sheet P can carry the toner image, i.e., an area W3 through which the maximum size sheet can pass. In other words, the area W3 is an area where contact can be made with a fixed toner image within an area of the fixing roller 31. Still further, the area W3 is narrower than the area W4 through which the maximum widthwise size sheet P can pass.

The surface roughnesses of the passing part 211, the non-passing parts 212, and the coba parts 213 vary, respectively, and differently in a case when a large number of sheets P is nipped and conveyed. It is noted that the respective surface roughnesses were measured by measuring ten-point average roughness Rz by using a surface roughness measuring device SE-3400 manufactured by Kosaka Laboratory Ltd., Japan. Measuring conditions adopted were 0.5 mm/s of the feed speed, 0.8 mm of a cutoff, and 2.5 mm of the measuring length.

The surface roughness of the fixing roller 21 at the passing part 211 is changed by surface conditions of the sheet P, such as fibers composing the sheet P and additive applied to the sheet P transported to the fixing roller 21 when the sheet P is nipped and conveyed. If the surface roughness of the fixing roller 21 is set at a mirror surface condition of Rz 0.1 μm to 0.3 μm, which is a general initial surface roughness for example, the surface roughness increases gradually from Rz 0.5 μm to 1.0 μm by the sheet P. Here, the change of the surface roughness of the respective fixing rollers 21 and 31 caused by the passage of the sheet P will be referred to also as an 'attack' in the following description.

The surface roughness of the fixing roller 21 at the non-passing part 212 is changed by the releasing layer 22*c* of the pressure roller 22 because the non-passing part 212 comes into contact with the releasing layer 22*c* of the pressure roller 22. The surface roughness of the fixing roller 21 changes from a range of Rz 0.1 μm to 0.3 μm to a range of Rz 0.4 μm to 0.7 μm, for example, by being in contact with the pressure roller 22 for a long period of time.

The surface roughness of the fixing roller 21 at the coba parts 213 changes by being attacked by burrs generated at both ends of the sheet P. The burr here is a cross sectional profile of the sheet P generated as a trace of a cut when the paper is cut by a sharp cutter. The burr will be detailed later. When the burr of the sheet P is nipped between the fixing and pressure rollers 21 and 22 at the coba part 213, undirectional minute holes are generated on the surface of the fixing roller 21. A large number of minute holes caused by the attack of the burr of the sheet P is generated on the surface of the fixing roller 21 by consecutively nipping and conveying (feeding) the sheets P of the same size, and a stripe flaw is generated along a circumferential direction at the coba part 213. Microscopically, this flaw is a unidirectional flaw. At this time, the surface roughness of the fixing roller 21 at the coba part 213 is Rz 1.0 μm to 1.2 μm, for example, as shown in FIG. 6B. That is, the surface roughness is large as compared to the surface roughnesses of the passing part 211 and the non-passing part 212. Here, the degree of the flaw generated at the coba part 213 varies depending on the type of the sheet P, and it is remarkable in conveying a sheet P having a large burr generated in cutting the sheet as compared to a case of conveying an ordinary thick or a coated sheet.

Figure 7:
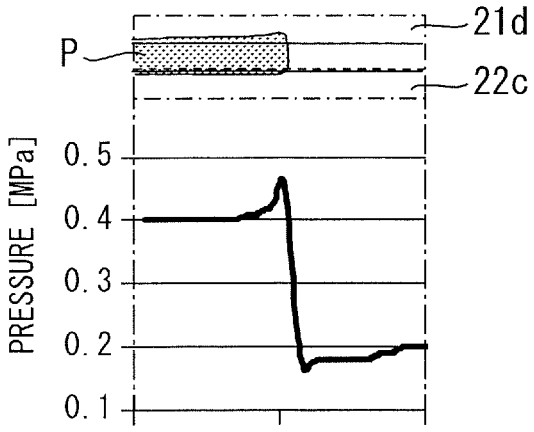
FIG. 7 is a graph indicating the pressure generated between a nip and a sheet of the first embodiment.

Here, in a case when the sheet P is relatively thick and is 300 μm for example as shown in FIG. 7, the pressure applied to the passing part 211 of the nip of each fixing apparatus is as large as twice of a pressure applied to the non-passing part 212. Because the pressure applied to the passing part 211 is greater than the pressure applied to the non-passing part 212, the surface roughness of the passing part 211 of the fixing roller 21 is liable to be changed more than the surface roughness of the non-passing part 212. Due to that, if the image forming apparatus 100 nips and consecutively conveys 500 sheets P that are relatively thick, the surface roughness of the passing part 211 is changed to around Rz 0.9 μm by the attack of the sheets P. The surface roughness of the non-passing part 212 is also changed to around Rz 0.5 μm by the attack of the pressure roller 22 in the image forming apparatus 100.

Thus, the image forming apparatus 100 is put into a condition in which the surface roughness of the fixing roller 21 is different in each area of the longitudinal direction of the fixing roller 21 by consecutively processing (consecutively feeding) the sheets P. It is known here that the shape of the surface of the fixing roller 21 is transcribed onto a surface of the toner image after fixation in fixing a non-fixed toner image onto a sheet by heating and pressing the toner image. Accordingly, if the surface condition of the fixing roller is different, the surface condition on the toner image is differentiated accordingly, and unevenness of glossiness (gloss unevenness) on the image is generated as a result. For instance, if the surface roughness in the longitudinal direction of the fixing roller 21 is largely differentiated as described above, the gloss unevenness is generated on the image fixed onto the sheet P. Specifically, a case when sheets P whose length in the longitudinal direction of the fixing roller 21 is different, are consecutively passed through the first nip N1, will be considered. At this time, the surface roughness in the longitudinal direction of the fixing roller 21 is differentiated at the respective areas by consecutively passing the small size sheets P. Then, if the large size sheets P are passed in this condition, the gloss unevenness is generated on images because the sheets pass through the parts where the surface roughnesses are different.

Here, a case when the sheet P is a UPM Fine 300 g/m$^2$ sheet manufactured by UPM Paper Co., i.e., a plain paper, will be exemplified. In this case, even if the sheet has less burr by favorably cutting the sheet, the image forming apparatus 100 is put into the condition in which the surface roughness in the longitudinal direction of the fixing roller 21 is different at the respective areas by consecutively processing a large number of sheets. At this time, because the sheet P has less burr, the surface roughness of the coba part 213 of the fixing roller 21 is not largely changed and the image forming apparatus 100 causes no gloss unevenness at the position of the sheet P corresponding to the coba part 213 in a large size sheet in forming an image on the sheet larger than the sheet P. However, the surface roughnesses of the passing and non-passing part 211 and 212 within the respective areas in the longitudinal direction of the fixing roller are changed from the initial surface roughness and are differentiated from each other because the image forming apparatus 100 processes the large number of sheets P as described above. As a result, in forming an image on a sheet larger than the sheet P, the image forming apparatus 100 ends up forming the image in which the gloss unevenness is perceived between a position of the sheet P corresponding to the passing part 211 and a position corresponding to the non-passing part 212 onto the large size sheet.

Here, the glossiness is recognized in general such that high glossiness is a condition in which a specular reflected light image is highly reproduced and low glossiness is a condition in which such specular reflected light image is reproduced less or not reproduced. For instance, in a case when one looks at an image such as a silver halide photo under lighting of a fluorescent lamp and in a case when not only the lighting of the fluorescent lamp but also the shape of the fluorescent lamp is projected in the image, one recognizes that the photo is highly glossy regardless whether or not one is conscious of this projection effect. At this time, the surface condition of the photograph image is in a mirror-surface condition with few irregularities. Meanwhile, in a case when the glossiness is low, the condition is reversed. That is, because the surface condition of the image is irregular, the light of the fluorescent light reflects irregularly, so that the shape of the fluorescent light will not be projected in the image. Thus, the irregularities of the surface condition on the image are correlated with the glossiness.

The gloss unevenness on the image caused by the difference of the surface roughnesses of the respective areas in the longitudinal direction of the fixing roller 21 is normally at a level at which one is unable to visually confirm this on a fine paper or the like used in general, for example. Meanwhile, the gloss unevenness is remarkable especially on a coated sheet whose surface is smooth and which excels in glossiness. In a case of fixing an image on a high gloss coated sheet or the like whose image quality is required to be high for example, the gloss unevenness is generated on the image, i.e., a low gloss stripe is inscribed at the position corresponding to the coba part 213 of the fixing roller 21 or a difference of glossiness is generated between the passing and non-passing parts 211 and 212. Among the gloss unevennesses generated on the sheet P, the stripe generated at the position corresponding to the coba part 213 is about 1 to 2 mm in width and appears remarkably when the sheet P to be processed is changed from what has been processed to a sheet larger than that. Meanwhile, among the gloss unevennesses generated on the sheet P, because the gloss unevenness generated between the passing and non-passing part 211 and 212 is extensive as compared to the gloss unevenness generated at the position corresponding to the coba part 213, the impression of the gloss unevenness is strong.

It is noted that in the following description, the gloss and glossiness will be referred to just as 'gloss'. Still further, the gloss unevennesses generated on the image formed on the sheet P between the coba part 213 and the passing part 211 and the non-passing part 212 will be referred also as a 'coba flaw' hereinafter. Still further, the gloss unevenness generated in the image formed on the sheet P between the passing part 211 and the non-passing part 212 will be referred to also as a 'gloss level difference' hereinafter.

[Burr of Sheet]

Figure 8:
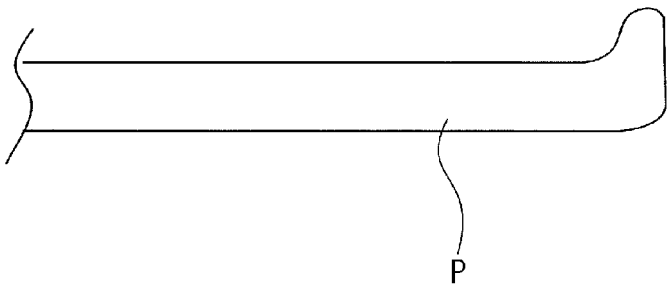
FIG. 8 is a schematic enlarged view of the sheet of the first embodiment.

Next, the burrs generated at the both widthwise edge parts of the sheet will be described. As shown in FIG. 8, the sheet P includes salient burrs generated at both edge parts of the sheet P in cutting the sheet P. Here, the burr of the sheet is liable to be generated when a cutting blade wears and becomes dull in a process of cutting sheets from a large size sheet in a papermaking process. Still further, because the burr of the sheet is a conglomeration of fibers of the sheet of paper, it is liable to be remarkably generated in a thick sheet. Still further, in a case where a sheet is a gloss coated sheet, a matt coated sheet, or the like, whose surface is coated by pigments, fibers are hardly disturbed and no burr is likely to be generated.

Figure 10:
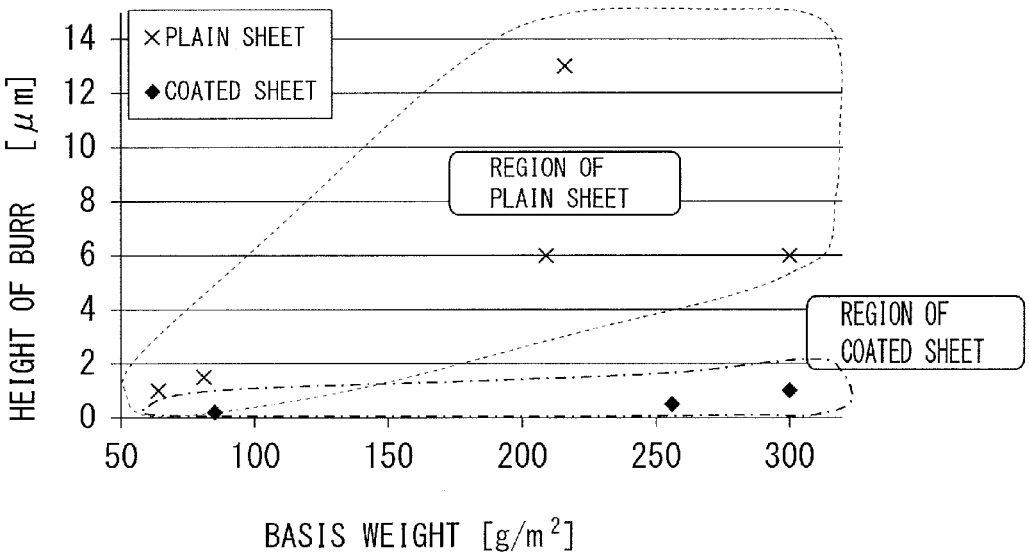
FIG. 10 is a graph showing a relationship between the basis weight and the height of burr of sheets of the first embodiment.

FIGS. 9 and 10 show relationships among types, basis weights, thicknesses, surface roughness, and height of burrs of sheets. That is, FIG. 9 is a table summarizing characteristics corresponding to the types of the sheets, and FIG. 10 is a graph showing a relationship between the basis weights of the sheets and the heights of the burrs. Here, the Bekk smoothness measurable, i.e., a physical property value, was measured as the surface roughness of the sheet. The height of the burr means a height of the burr salient more than a thickness of the sheet.

As shown in FIGS. 9 and 10, the height of the burr of the thick sheets whose basis weight is large tends to be large because a strong force is applied in cutting the sheets and the amount of fibers composing those sheets is large. Still further, the average height of burrs of the plain sheets tends to be high, and the height of the burr of some of the sheets whose basis weight exceeds 200 g/m$^2$ is around 15 μm. The height of burrs of the coated sheets is low in general, and the coated sheets produced less paper dust of the edge cut surface. It is noted that in terms of Bekk smoothness, the plain sheets and matt coated sheets tend to be rough and the gloss coated sheets are smooth.

[Range of Surface Roughness of Fixing Roller]

Next, an optimal range of the surface roughness of the fixing rollers 21 and 31 of the present embodiment will be described. First, relationships among the surface roughness of the fixing roller 21 of the first fixing apparatus 20, the surface roughness of the fixing roller 31 of the second fixing apparatus 30, and the glossiness of an image formed on the sheet P of the present embodiment will be detailed with reference to FIGS. 11 through 14.

Figure 11:
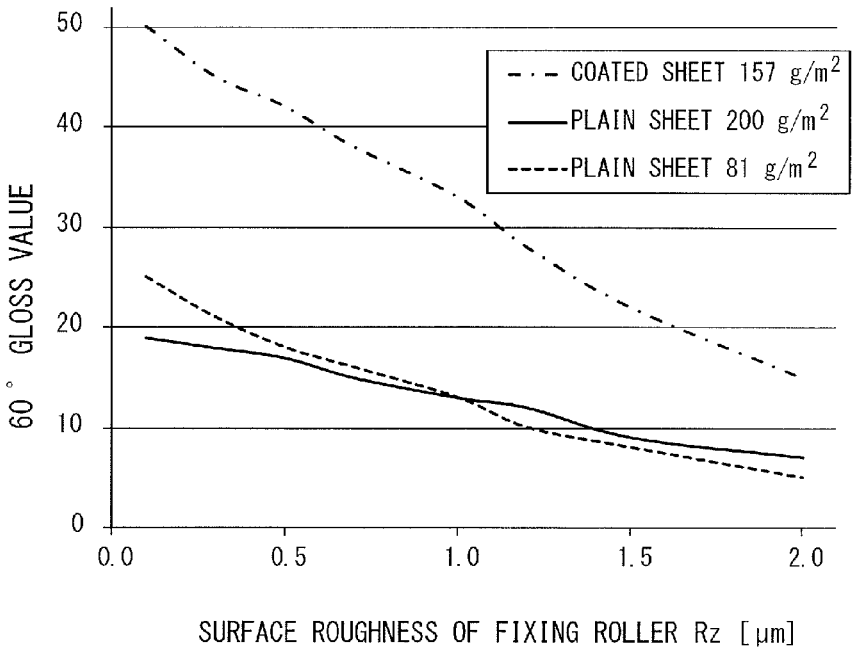
FIG. 11 is a graph showing a relationship between a number of sheets on which images have been fixed and the glossiness of the images in the image forming apparatus of the first embodiment.

FIG. 11 is a graph illustrating the relationship between the surface roughness of the fixing roller of the most downstream fixing apparatus provided most downstream in the sheet conveying direction among the fixing apparatuses provided on the conveying route of the sheet P and a 60° gloss value indicating glossiness of an image based on reflectivity of incident light inputted to the image formed on the sheet with an incident angle of 60°. In the present embodiment, the CPU 400 of the image forming apparatus 100 changes the conveying route depending on whether or not the basis weight of the sheet is lower than 150 g/m$^2$ (predetermined value) as a printing condition because the quantity of heat necessary for fixing the image and improving the glossiness varies depending on the thickness and the thermal capacity of the sheet. Specifically, the CPU 400 conveys the sheet P to a first conveying route 42 passing only the first fixing apparatus 20 when the basis weight of the sheet P is less than 150 g/m$^2$. Still further, the image forming apparatus 100 is arranged to convey the sheet P to a second conveying route 43 passing through the first and second fixing apparatuses 20 and 30 when the basis weight of the sheet P is greater than 150 g/m$^2$. Here, the image forming apparatus 100 may be arranged so as to store the type of sheets, stored in the sheet feed cassette 40, inputted by the user in advance in a memory. In such a case, the CPU 400 acquires the basis weight of the sheet onto which an image is to be formed from the relationship (Table) between the type and basis weight of the sheets stored in the memory. Thus, the CPU 400 constitutes a type acquiring portion acquiring the type of the sheet P.

From the arrangement described above, the plain sheet whose basis weight is 81 g/m$^2$ passes only through the first fixing apparatus 20. The coated sheet whose basis weight is 157 g/m$^2$ and the plain sheet whose basis weight is 209 g/m$^2$ pass through the first and second fixing apparatuses 20 and 30. It is noted that in FIG. 11, a line of the plain sheet whose basis weight is 81 g/m$^2$ passing only through the first fixing apparatus 20 indicates the relationship between the surface roughness of the fixing roller 21 and the glossiness. Meanwhile, lines of the coated sheet whose basis weight is 157 g/m$^2$ and the plain sheet whose basis weight is 209 g/m$^2$ passing also through the second fixing apparatus 30 indicate the relationship between the surface roughness of the fixing roller 31 and the glossiness. Still further, in the case of the coated sheet whose basis weight is 157 g/m$^2$ and the plain sheet whose basis weight is 209 g/m$^2$, the surface roughness of the fixing roller 21 of the first fixing apparatus 20 is fixed to about Rz 1.0 μm in order to measure the relationship between the surface roughness of the fixing roller 31 of the second fixing apparatus 30 and the glossiness. Still further, A3 elongation size sheets are used as the respective plain and coated sheets, and a black monochrome image whose density is about 1.6 (maximum density) is formed homogeneously on an entire surface of the sheets (entire solid image).

Here, if the glossiness of an image formed on a sheet is lowered to be less than the sheet glossiness, i.e., glossiness of the sheet itself, the roughness of the toner image (gloss unevenness) becomes visible on the surface of the image. Due to that, an image having a glossiness higher than that of the sheet glossiness is formed to forma high quality image which excels in glossiness.

[Range of Surface Roughness of Fixing Roller of First Fixing Apparatus]

As shown in FIG. 11, in the case of the plain sheet whose basis weight is 81 g/m$^2$, the 60° gloss value of the sheet P becomes lower than the sheet glossiness of about 7 if the surface roughness of the fixing roller 21 becomes greater than Rz 1.5 μm. That is, if the surface roughness of the fixing roller 21 becomes greater than Rz 1.5 μm, the glossiness of the image becomes lower than the sheet glossiness of the plain sheet and an image part gives a depressed impression. Still further, because the surface roughness of the fixing roller 21 becomes larger than Rz 1.5 μm, the gloss unevenness on the surface layer of the image becomes readily visible. Still further, if the surface roughness of the fixing roller 21 becomes greater than Rz 1.5 μm, the releasability of toner from the surface of the fixing roller 21 drops, possibly causing a hot offset by which a part of the image on the sheet is transferred to the fixing roller. Accordingly, the surface roughness of the fixing roller 21 is preferable to be less than Rz 1.5 μm. It is noted that a disturbance of an image becomes conspicuous if a flaw of one point is deep even if the surface roughness of the fixing roller 21 is less than Rz 1.5 μm. Therefore, the maximum value of the depth of a flaw is desirable to be 2.0 μm at most.

Figure 12:
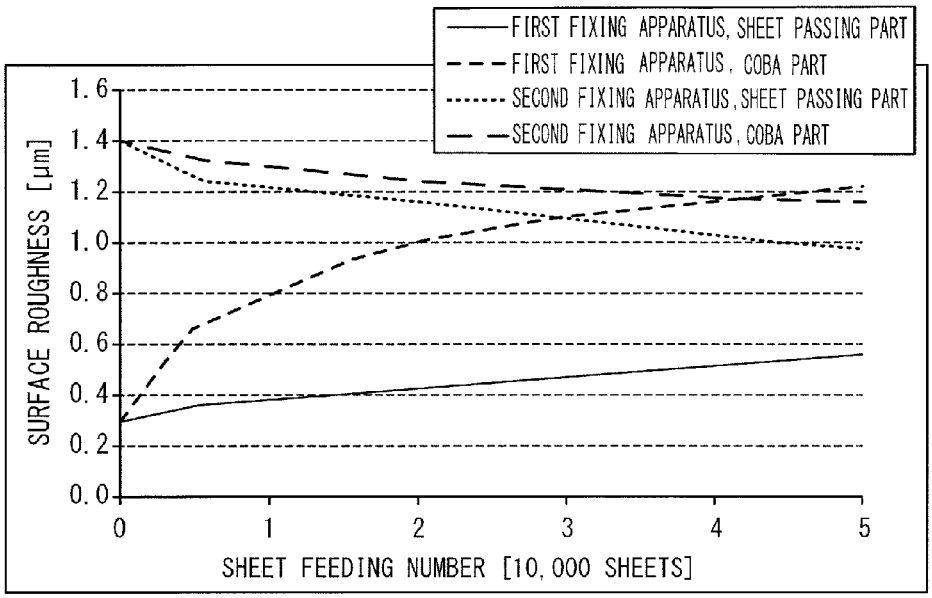
FIG. 12 is a graph showing a relationship between a number of sheets on which images have been fixed and surface roughnesses of the first and second heating rotators in the image forming apparatus of the first embodiment.
Figure 13:
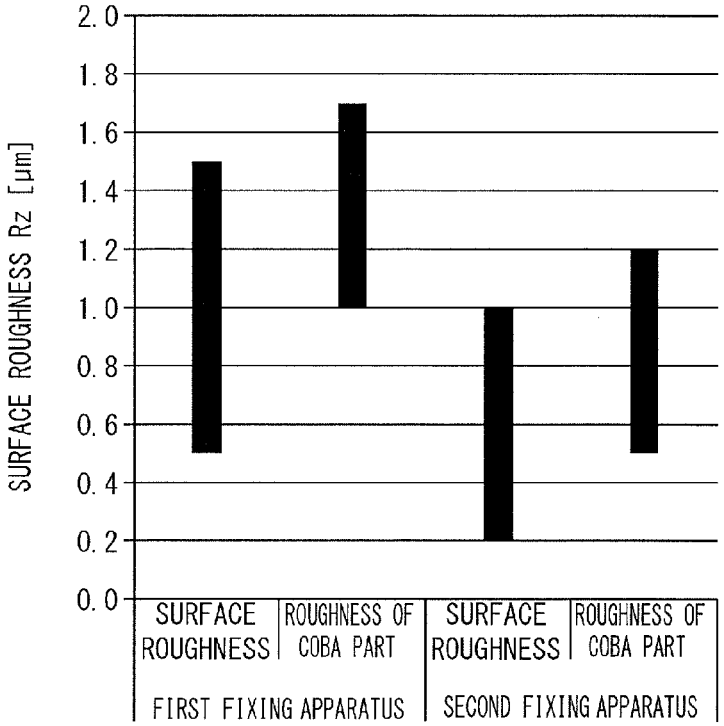
FIG. 13 is a graph showing upper and lower limit values of the surface roughnesses of the first and second heating rotators of the first embodiment.

In a case when the surface roughness of the fixing roller 21 of the first fixing apparatus 20 is Rz 0.1 μm to 0.3 μm for example, the surface roughness of the coba part 213 is liable to exceed Rz 1.0 μm by being attacked by the burr of the sheet P as shown in FIG. 12. In such a case, a large difference is liable to be generated between the surface roughnesses of the passing part 211 and the coba part 213 and the coba flaw appears, making it difficult for the image forming apparatus 100 to obtain enough glossiness even if the total number of processed sheets is as small as less than 10,000 sheets. Due to that, the surface roughness of the fixing roller 21 (first fixing portion) is set to be more than 0.5 μm and less than 1.5 μm as shown in FIG. 13 in the present embodiment.

[Range of Surface Roughness of Fixing Roller of Second Fixing Apparatus]

As shown in FIG. 11, in the case of the coated sheet, the 60° gloss value of the sheet P becomes lower than the sheet glossiness of about 38 if the surface roughness of the fixing roller 31 becomes greater than Rz 1.0 μm. That is, if the surface roughness of the fixing roller 31 becomes greater than Rz 1.0 μm, the glossiness of the image becomes lower than the sheet glossiness of the coated sheet. That is, the glossiness of the sheet surface is liable to be stressed, and it is not preferable for the glossiness of the image to become lower than the sheet glossiness in the coated sheet whose sheet glossiness is high. Still further, because the surface roughness of the fixing roller 31 becomes greater than Rz 1.0 μm, irregularities of the image become conspicuous on the coated sheet whose surface is smooth, and the user is liable to recognize that the gloss unevenness is generated. Accordingly, the surface roughness of the fixing roller 31 is preferable to be less than Rz 1.0 μm. It is noted that a disturbance of an image becomes conspicuous if a flaw of one point is deep even if the surface roughness of the fixing roller 31 is less than Rz 1.0 μm. Therefore, the maximum value of the depth of a flaw is desirable to be 1.5 μm at most.

The height of the burr is lowered and sharp parts thereof are reduced in the fixing roller 31 of the second fixing apparatus 30 because the sheet P has been pressed by the first nip N1 of the first, upstream fixing apparatus 20 and the burrs have been crushed. Therefore, the influence of the attack of the burr of the sheet P on the fixing roller 31 is not so remarkable as compared to that of the fixing roller 21. However, similarly to the surface roughness of the fixing roller 21, if the surface roughness of the fixing roller 31 is so small as Rz 0.1 μm to 0.2 μm for example, the surface roughness of the coba part 213 is liable to exceed Rz 1.0 μm by being attacked by the burr of the sheet P. Still further, if very small foreign matter, such as paper dust and metal dust enter the second nip N2 of the second fixing apparatus 30, those foreign matters will not be conspicuous by being buried by the roughness of the surface if the surface roughness of the fixing roller 31 is Rz 0.5 μm to 0.7 μm. However, if the surface roughness of the fixing roller 31 is Rz 0.1 μm to 0.2 μm, a flaw on the surface inscribed by the foreign matter appears on the image. Due to that, the surface roughness of the fixing roller 31 (second fixing portion) is set to be more than 0.2 μm and less than 1.0 μm as shown in FIG. 13 in the present embodiment.

FIG. 14 is a table summarizing the requirements in setting upper and lower limits of the surface roughnesses of the respective fixing rollers 21 and 31 based on the characteristics of the surface roughnesses of the respective fixing rollers 21 and 31 described above. The functions of the first and second fixing apparatuses 20 and 30 are different, respectively, as described above. Accordingly, adequate values of the surface roughnesses of the respective fixing rollers 21 and 31 of the first and second fixing apparatuses 20 and 30 are different, respectively. That is, it is preferable to make uniform the surface roughness of the upstream fixing roller 21, upstream in the sheet conveying direction, in the longitudinal direction within a range which does not affect the fixability of the toner image, which, when affected can cause a problem such as hot offset and which allows enough glossiness to be obtained in forming an image on a plain sheet whose basis weight is low. Still further, it is preferable to bring the surface roughness of the most downstream fixing roller 31 most downstream in the sheet conveying direction to be close to flat to form an image excellent in glossiness on the sheet P because fine rubbing flaws may appear on the image.

Accordingly, in the present embodiment, the surface roughness of the fixing roller 21 of the first fixing apparatus 20 is roughened more than the surface roughness of the fixing roller 31 of the second fixing apparatus 30. Because the upper and lower limits of the surface roughnesses Rz are determined under the respective conditions as shown in Table shown in FIG. 14, the ranges of the surface roughnesses are determined as shown in FIG. 13 described above. It is noted that in FIG. 13, the ranges of the surface roughnesses are indicated corresponding to the roughness of the coba parts of the first and second fixing apparatuses 20 and 30. Here, although the surface roughness of a new unused fixing roller is advantageously high in terms of the gloss unevenness of the coba flaw, upper limits of the roughness are limited, respectively, as described above. The surface roughness of the fixing roller 21 of the first fixing apparatus 20 can be higher than the surface roughness of the fixing roller 31 of the second fixing apparatus 30. Therefore, it is desirable to differentiate the initial roller surface layers of the fixing rollers 21 and 31 in order to prolong their lives and to optimize image glossiness.

Still further, in terms of the lower limit values of the surface roughnesses of the fixing rollers, a permissible lowest value of the surface roughness of the fixing roller 21 is set to be higher than a permissible lowest value of the surface roughness of the fixing roller 31 in the same manner.

[Verification of Advantageous Effect]

Based on the relationship of the surface roughnesses of the fixing rollers 21 and 31 described above, experiments were carried out to verify the advantageous effects of the measures for effecting the gloss unevenness on the surface of an image caused under the fixing processes. Here, an initial surface roughness of the fixing roller 21 of the first fixing apparatus 20 was set at Rz 1.4 μm, and an initial surface roughness of the fixing roller 31 of the second fixing apparatus 30 was set at Rz 1.0 μm, respectively. Still further, because the releasing layers 21*d* and 31*d* of the respective fixing rollers 21 and 31 are fluororesin tubes and their surface roughnesses right after their manufacturing are Rz 0.1 μm to 0.3 μm, their initial surface roughnesses were set by pressing and rubbing by a polishing member such as a wrapping film.

That is, although it is advantageous to set the surface roughness of the fixing roller 21 to be high in order to restrain the influence of the attack of the burr of the sheet P and to prevent coba flaws from being generated, it is also necessary not to adversely affect the fixability of the toner image. Still further, the surface roughness of the fixing roller 21 may be roughened more than the surface roughness of the fixing roller 31 of the second fixing apparatus 30 to improve the glossiness of the image as long as the fixing roller 21 can fix the toner image on the sheet P and can bring about enough glossiness in fixing the image on a plain sheet whose basis weight is small. Then, the initial surface roughness was set at Rz 1.4 μm in order to uniform the longitudinal surface roughness of the fixing roller 21 within a range in which enough glossiness is brought about in forming the image on the plain sheet whose basis weight is small without affecting the fixability of the toner image. Still further, the initial surface roughness of the fixing roller 31 was set at Rz 1.0 μm because it is necessary to keep the surface roughness to be more flat in order to improve the glossiness of the image formed on the sheet P, such as a coated sheet.

The sheets P of the plain sheet of A4 size whose basis weight was 209 g/m$^2$ were consecutively nipped and conveyed through the first and second fixing apparatuses 20 and 30 in which the initial surface roughnesses of the fixing rollers 21 and 31 had been set as described above to fix images on the respective sheets.

The attack of the burr of the sheet P has less influence on the fixing roller 21 by setting the initial surface roughness at Rz 1.4 μm. Due to that, the surface roughness at the coba part 213 is kept at a value close to the initial surface roughness of Rz 1.4 μm by the attack of the burr of the sheet P. Meanwhile, the surface roughness of the passing part 211 in the fixing roller 21 is gradually reduced by being leveled by the attack of the sheets P. However, no gloss unevenness was generated in the images formed on the sheets P until 50,000 sheets were nipped and conveyed. It is noted that the surface roughness of the passing part 211 was finally lowered to around Rz 0.5 μm in the fixing roller 21. Still further, in a stage in which more than 50,000 sheets have been nipped and conveyed, the difference between the surface roughness of the passing part 211 and the surface roughness of the coba part 213 increased in the fixing roller 21, and the gloss unevenness, such as coba flaws and gloss level differences in changing sheet sizes, became visible.

While the initial surface roughness of the fixing roller 31 was Rz 1.0 μm, the surface roughness of the fixing roller 31 is not affected so much by the attack of the burr of the sheet P because the burr of the sheet P has been crushed at the first fixing nip N1 of the first fixing apparatus 20. Therefore, on the fixing roller 31, the surface roughness of the coba part 213 is kept at a value close to the initial surface roughness of Rz 1.0 μm by the attack of the burr of the sheet P crushed by the fixing first nip N1 of the first fixing apparatus 20. Meanwhile, in the fixing roller 31, the surface roughness of the passing part 211 is reduced gradually by being leveled by the attack of the sheet P. However, because the surface of the fixing roller 31 corresponding to the coba part 213 is roughened less than that of the fixing roller 21, the difference from the surface roughness of the passing part 211 was not so large. Still further, the difference of the surface roughnesses of the passing part and the non-passing part 211 and 212 was at a level of generating the gloss level difference at the moment of time when 50,000 sheets P have been nipped and conveyed.

An experiment as shown in FIG. 12 was carried out as a first comparative example. In the first comparative example, a consecutive processing was started by setting the initial surface roughness of the fixing roller (first fixing portion) of the first fixing apparatus at Rz 0.3 μm and the surface roughness of the fixing roller (second fixing portion) of the second fixing apparatus at Rz 1.4 μm. The other conditions were equalized with those of the case described above. In terms of the first fixing apparatus 20, the difference of roughness between those of the passing part and the coba part largely expanded and was visually recognized as the sheet coba flaw described above at a point of time when about 10,000 sheets have been conveyed. In terms of the second fixing apparatus 30, although the difference of roughness between those of the passing part and the coba part did not largely expand, a difference of surface roughness was generated between the sheet passing area (sheet feed area) and the non-sheet passing area (non-sheet feed area) of the fixing roller. Then, when a high gloss sheet whose width is wider than that of the sheet used in carrying out the consecutive processing was fed, the glossiness on the image around the center of the passing area was different from that around edge part of the non-passing area. It was recognized as a gloss level difference. It was generated because while the surface roughness of the passing part was leveled to Rz 0.6 μm relatively quickly, the surface roughness of the non-passing part was leveled by the attack of the pressure roller, without being affected by the sheet P, and the change of the roughness was moderate. It is noted that this gloss level difference is generated more remarkably when the initial surface roughness of the fixing roller 31 is increased.

FIG. 15 briefly illustrates what the verification results of the first comparative example were compared with verification results of the abovementioned arrangement in which the initial surface roughnesses of the respective fixing rollers 21 and 31 were differentiated. In the case of the first comparative example, the influence of the sheet burr flaw (coba flaw) was remarkably seen as compared to the cases in which the initial surface roughnesses of the respective fixing rollers 21 and 31 were differentiated. Because the influence of the coba flaw was remarkably seen, 'X' is marked in a column indicating a coba flaw of the first comparative example in FIG. 15.

In the case of the present embodiment, the surface roughness of the fixing roller 21 of the first fixing apparatus 20 is greater than the surface roughness of the fixing roller 31 of the second fixing apparatus 30 as described above. Accordingly, it is possible to reduce influences such as rubbing of the burr of the sheet P on the fixing roller 21 for a long period of time and to prolong the life of the apparatus. Still further, it is possible to form a high quality image which excels in glossiness on the sheet P by reducing the surface roughness of the fixing roller 31 of the second fixing apparatus 30 which is influenced less by rubbing of the burr of the sheet P to be less that the surface roughness of the fixing roller 21.

The abovementioned arrangement makes it possible to restrain the influence of the attack of the burr of the sheet because a high enough quantity can be supplied to the sheet at the nip, even if the pressure at the nip of each fixing apparatus is kept low, if the number of output sheets per unit time is low, i.e., if a processing speed is low. Due to that, it is possible to improve the life of each fixing apparatus to be bearable to form images for several thousands of sheets by setting the initial surface roughness of the fixing roller of each fixing apparatus as described above. However, if the number of output sheets per unit time is increased, i.e., if the processing speed is increased, to increase productivity of the image forming apparatus, the pressure at the nip of each fixing apparatus is increased to fully supply the heat quantity to the sheet. In such a case, the natures of the surfaces of the fixing rollers 21 and 31 of the first and second fixing apparatuses 20 and 30 are liable to be changed from the initial state by strongly receiving the influences of the attack of the burr of the sheet P, of the passage of the sheet, and of the contact with the pressure rollers 22 and 32.

Accordingly, an arrangement is made to be able to directly set the surface roughnesses of the fixing rollers 21 and 31 in the present embodiment. That is, the first and second fixing apparatuses 20 and 30 include refresh rollers 23 and 33, i.e., first and second rubbing members (first and second rubbing rollers), rubbing the releasing layers 21*d* and 31*d* formed on the surfaces of the fixing rollers 21 and 31 and setting the surface roughnesses of the fixing rollers 21 and 31, respectively. Then, the surface roughnesses of the fixing rollers 21 and 31 are stably maintained at desirable surface roughnesses by rubbing the surfaces of the fixing rollers 21 and 31 by the refresh rollers 23 and 33, respectively.

[First Fixing Apparatus and First Rubbing Member]

Figure 16:
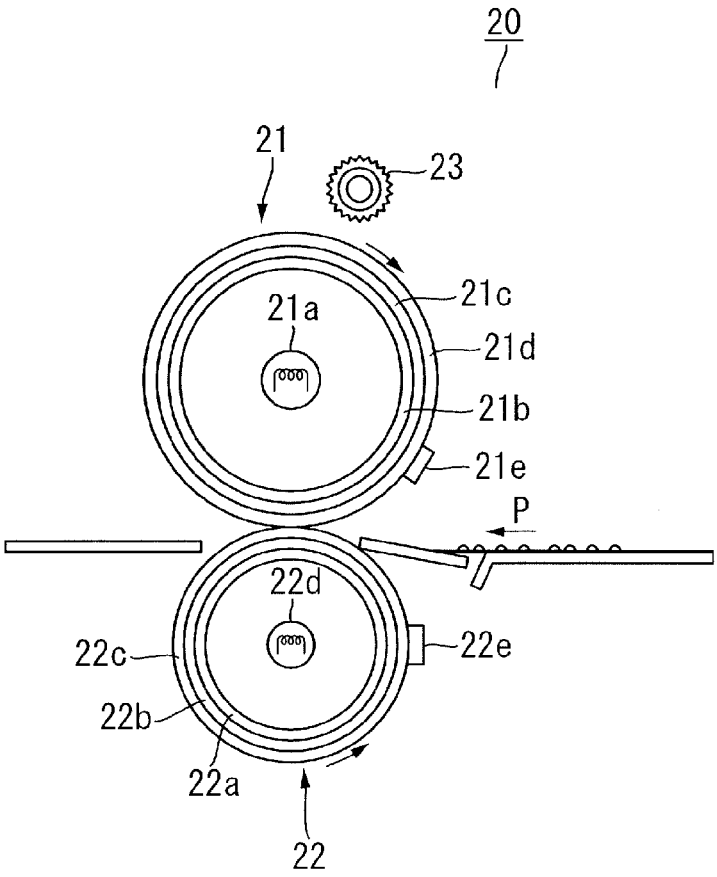
FIG. 16 is a schematic section view illustrating a configuration of the first fixing apparatus and a first rubbing member of the first embodiment.

FIG. 16 is a schematic section view illustrating the first fixing apparatus 20 and the refresh roller 23, i.e., the first rubbing member, of the present embodiment. As shown in FIG. 16, the refresh roller 23 is provided at a position being able to be in contact with the releasing layer 21*d*, i.e., the surface, of the fixing roller 21 and is arranged to be movable in a direction of coming in contact with and of being kept away from the releasing layer 21*d* by a moving mechanism 23*f* described later. Here, the refresh roller 23 roughens at least the area W1 (see FIG. 6) of the surface of the fixing roller 21 to the desirable surface roughness. It is noted that the refresh roller 23 roughens the entire area of the surface of the fixing roller 21 in the present embodiment.

In the present embodiment, the pressure roller 22 of the first fixing apparatus 20 is pressed against the fixing roller 21 with 800 N of total pressure for example. That is, the pressure roller 22 is pressed to the fixing roller 21 more strongly than the pressure roller 22 of the abovementioned case where the first fixing apparatus 20 includes no refresh roller. This arrangement makes it possible for the first fixing apparatus 20 to fully heat and press the toner image carried on the sheet P even if the fixing roller 21 is rotationally driven by the motor 21*f* with a circumferential speed of 220 mm/sec for example, which is faster that the abovementioned circumferential speed (100 mm/sec).

Figure 17A:
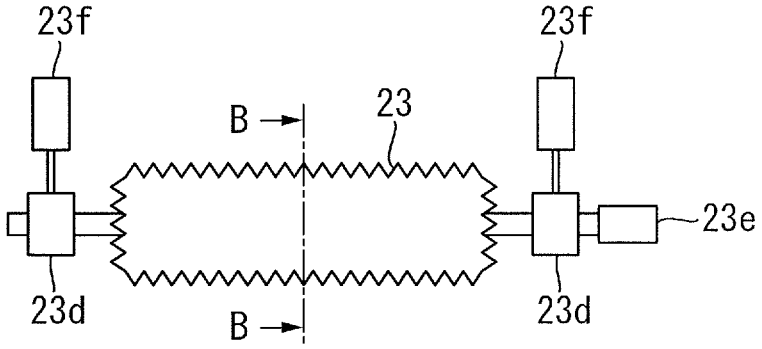
FIG. 17A is a schematic front view illustrating the first rubbing member of the first embodiment.
Figure 17B:
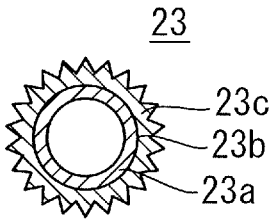
FIG. 17B is a section view illustrating the first rubbing member taken along a section indicated by arrows B-B in FIG. 17A.

FIGS. 17A and 17B are schematic front and section views illustrating the details of the refresh roller 23. As shown in FIGS. 17A and 17B, the refresh roller 23 is composed of a rotatable first rubbing rotator by providing an adhesive layer 23*b*, i.e., an intermediate layer, on a metallic core shaft 23*a*, i.e., a base layer, and by providing a rubbing layer 23*c*, i.e., a surface layer, further on the adhesive layer 23*b*. The core shaft 23*a* is composed of a SUS 304 (stainless steel) member formed into a cylindrical shape of 12 mm of outer diameter, for example. The adhesive layer 23*b* is composed of an adhesive which can adhere a rubbing material composing the rubbing layer 23*c* to the core shaft 23*a*. The rubbing layer 23*c* is formed by tightly adhering abrasive grains, i.e., the rubbing material. Here, as the rubbing material composing the rubbing layer 23*c*, aluminum oxide, aluminum hydroxide oxide, silicon oxide, cerium oxide, titanium oxide, zirconia, and lithium silicate can be used. Still further, beside the materials described above, silicon nitride, silicon carbide, iron oxide, chrome oxide, antimony oxide, diamond, and blends of the materials described above can be used as the rubbing material composing the rubbing layer 23*c*.

In the present embodiment, a material whose main component is aluminum oxide, i.e., so-called alumina base material (referred to also as Alundum or Molundum (registered trade mark)) was used as the rubbing material composing the rubbing layer 23*c*. The alumina base abrasive grain is generally a widely used abrasive grain whose hardness is fully high as compared to the fluororesin composing the releasing layer 21*d* of the fixing roller 21 and which excels in machinability because of its acute shape. Still further, because each abrasive grain of the rubbing material composing the rubbing layer 23*c* is a particle whose particle size is 5 μm to 20 μm for example, the thickness of the rubbing layer 23*c* can be 5 μm to 20 μm, for example. By setting the particle size of each particle of the rubbing material composing the rubbing layer 23*c* to 5 μm to 20 μm, it becomes possible for the refresh roller 23 to stably maintain the surface roughness of the fixing roller 21 to the desirable surface roughness of 0.5 μm to 1.5 μm (more than 0.5 μm and less than 1.5 μm) by executing a rubbing operation based on rubbing conditions described later. It is noted that in the present embodiment, an arrangement is made such that the surface roughness of the fixing roller 21 is converged to 1.5 μm when the refresh roller 23 travels on the surface of the fixing roller 21 by more than 50 meters. At this time, the refresh roller 23 functions as a roughening member for roughening the surface of the fixing roller 21 to the surface roughness of 1.5 μm.

The refresh roller 23 is rotably supported by supporting members 23*d* provided at both ends in a longitudinal direction (rotation axial line direction) of the core shaft 23*a* and is rotationally driven by a motor 23*e*, i.e., a first rotational driving member. The motor 23*e* rotationally drives the refresh roller 23 with a first rubbing circumferential speed having a first circumferential speed difference with respect to the circumferential speed of the fixing roller 21. Still further, the refresh roller 23 is moved in the direction of coming into contact with and being separated from the fixing roller 21 by a moving mechanism 23*f*, i.e., a first moving contact/separate portion and a first press portion, provided at the supporting member 23*d*. While the moving mechanism 23*f* is not shown in detail, the moving mechanism 23*f* includes a cam mechanism and a spring and moves the refresh roller 23 in the direction of coming into contact with and separating from the fixing roller 21 by driving a cam. That is, the moving mechanism 23*f* brings the refresh roller 23 into contact with the fixing roller 21 at an adequate timing of non-fixing time during which the first fixing apparatus 20 nips and conveys no sheet P and presses the refresh roller 23 against the fixing roller 21 when they are in contact with each other. As a result, a rubbing nip of a predetermined width is formed between the refresh roller 23 and the fixing roller 21. Meanwhile, the moving mechanism 23*f* keeps the refresh roller 23 away from the fixing roller 21 during a time other than that. The rubbing operation in which the refresh roller 23 rubs the releasing layer 21*d* of the fixing roller 21 to set the surface roughness of the fixing roller 21 will be described later.

[Second Fixing Apparatus and Second Rubbing Member]

Figure 18A:
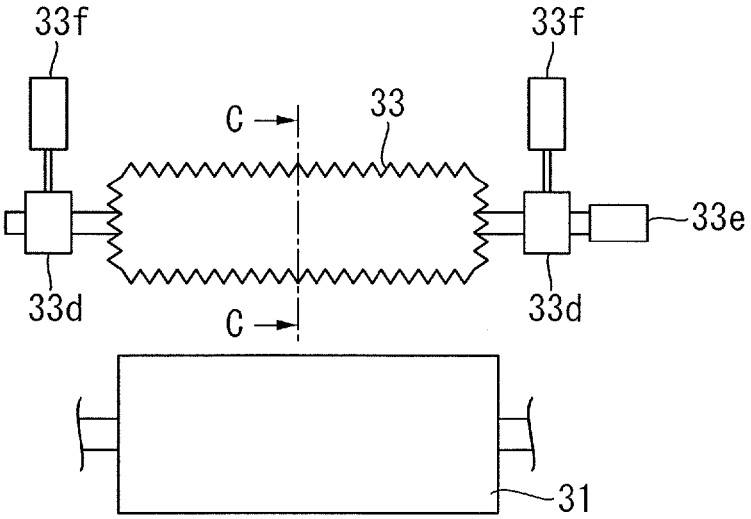
FIG. 18A is a schematic front view illustrating the second heating rotator and a second rubbing member of the first embodiment.
Figure 18B:
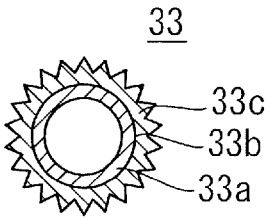
FIG. 18B is a section view illustrating the second rubbing member taken along a section indicated by arrows C-C in FIG. 18A.

FIGS. 18A and 18B are schematic front and section views illustrating the details of the refresh roller 33. Here, in the present embodiment, each member composing the second fixing apparatus 30 and the refresh roller 33 having the same configuration with that composing the first fixing apparatus 20 and the refresh roller 23 will be denoted by the same reference numeral and an explanation thereof will be omitted here. The refresh roller 33 is arranged to roughen at least the area W3 (see FIG. 6) of the surface of the fixing roller 31 to the desirable surface roughness. It is noted that the refresh roller 33 roughens the entire area of the surface of the fixing roller 31 in the present embodiment.

As shown in FIGS. 18A and 18B, the refresh roller 33 is composed of a rotatable second rubbing rotator by providing an adhesive layer 23*b*, i.e., an intermediate layer, on a metallic core shaft 33*a*, i.e., a base layer, and by providing a rubbing layer 33*c*, i.e., a surface layer, further on the adhesive layer 33*b*. The rubbing layer 33*c* is formed by tightly adhering abrasive grains, i.e., the rubbing material. Here, as the rubbing material composing the rubbing layer 33*c*, the same rubbing material as that of the rubbing layer 23*c* of the refresh roller 23 can be used. Therefore, a contact area between the refresh roller 33 and the fixing roller 31 is equal to a contact area between the refresh roller 23 and the fixing roller 21. Accordingly, in a case when a pressurizing force applied to the refresh roller 23 is equalized to that of the refresh roller 33, a contact pressure between the refresh roller 33 and the fixing roller 31 is equal to a contact pressure between the refresh roller 23 and the fixing roller 21.

In the present embodiment, because the rubbing material composing the rubbing layer 33*c* is composed of abrasive grains whose particle size is 5 μm to 20 μm for example, the thickness of the rubbing layer 33*c* can be 5 μm to 20 μm for example. By setting the particle size of each particle of the rubbing material composing the rubbing layer 33*c* to 5 μm to 20 μm for example, it becomes possible for the refresh roller 33 to stably maintain the surface roughness of the fixing roller 31 to the desirable surface roughness of 0.2 μm to 1.0 μm (more than 0.2 μm and less than 1.0 μm) by executing a rubbing operation based on rubbing conditions described later. It is noted that in the present embodiment, an arrangement is made such that the surface roughness of the fixing roller 31 is converged to 1.0 μm when the refresh roller 33 travels on the surface of the fixing roller 31 by more than 50 meters. At this time, the refresh roller 33 functions as a roughening member for roughening the surface of the fixing roller 31 to the surface roughness of 1.0 μm.

It is noted that the glossiness of an image formed on the sheet P is largely affected by the surface roughness of the fixing roller 31 as described above. Therefore, the image forming apparatus 100 is configured such that the surface roughness of the fixing roller 31 set by the refresh roller 33 is smaller than the surface roughness of the fixing roller 21 by changing the rubbing conditions of the rubbing operation performed by the refresh roller 33 described later from the rubbing conditions of the refresh roller 23.

The refresh roller 33 is rotably supported by supporting members 33*d* provided at both ends in a longitudinal direction (rotation axial line direction) of the core shaft 33*a* and is rotationally driven by a motor 33*e*, i.e., a second rotational driving member. The motor 33*e* rotationally drives the refresh roller 33 with a second rubbing circumferential speed having a second circumferential speed difference with respect to the circumferential speed of the fixing roller 31. Still further, the refresh roller 33 is moved in a direction of coming into contact with and moving away from the fixing roller 31 by a moving mechanism 33*f*, i.e., a second contact/separate moving portion and a second press portion, provided at the supporting member 33*d*. The moving mechanism 33*f* is constructed in the same manner as the moving mechanism 23*f* described above. The moving mechanism 33*f* brings the refresh roller 33 into contact with the fixing roller 31 at an adequate timing of a non-fixing time of the second fixing apparatus 30 and presses the refresh roller 33 against the fixing roller 31 when they are in contact with each other. As a result, a rubbing nip of a predetermined width is formed between the refresh roller 33 and the fixing roller 31. Meanwhile, the moving mechanism 33*f* keeps the refresh roller 33 away from the fixing roller 31 during a time other than that. The rubbing operation in which the refresh roller 33 rubs the releasing layer 31*d* of the fixing roller 31 to set the surface roughness of the fixing roller 31 will be described later.

[Control Portion]

Figure 19:
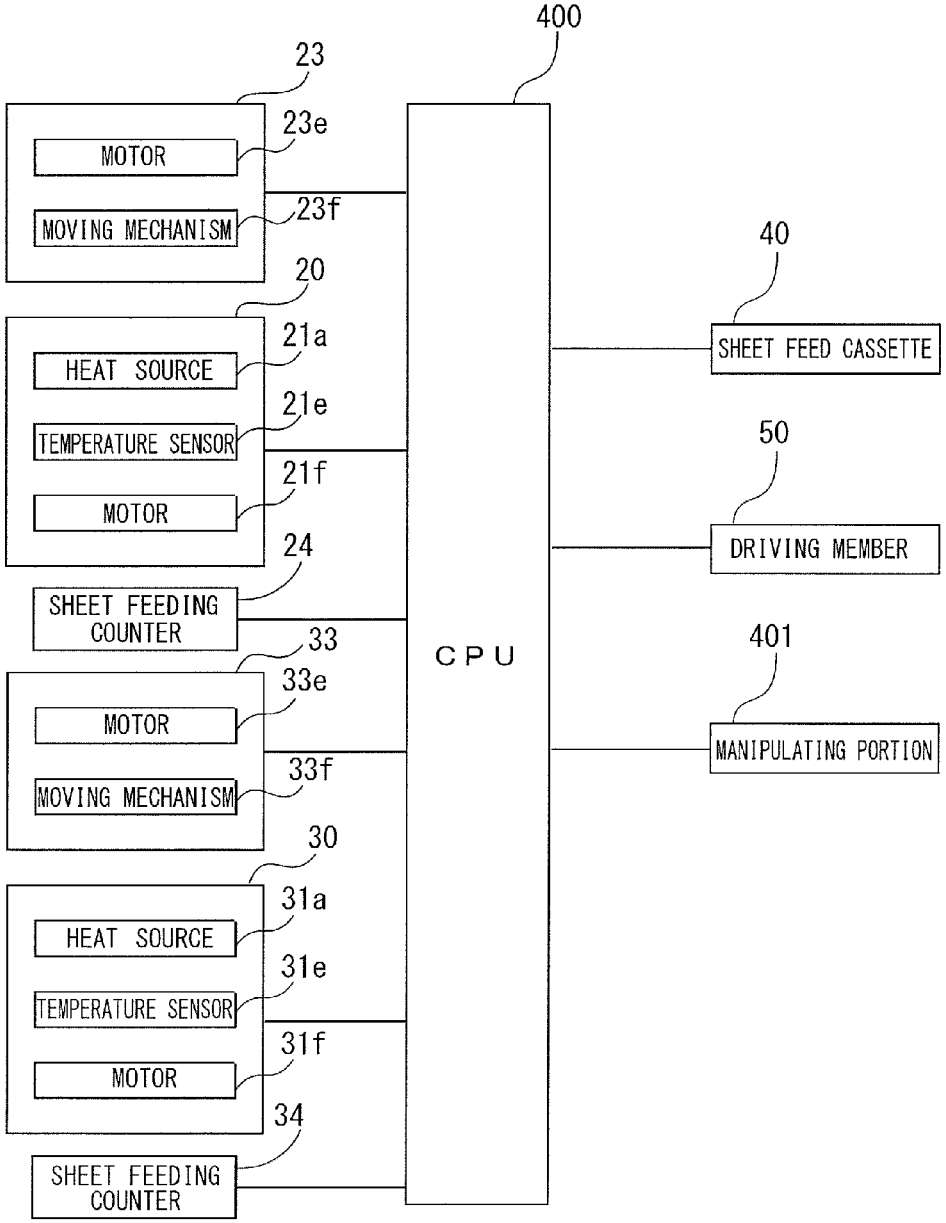
FIG. 19 is a control block diagram of the image forming apparatus of the first embodiment.

FIG. 19 is a block diagram illustrating a control portion provided in the image forming apparatus 100 when the first and second fixing apparatuses 20 and 30 include the refresh rollers 23 and 33, respectively. As shown in FIG. 19, the CPU 400 is electrically connected with the first and second fixing apparatuses 20 and 30, the motor 23*e* and the moving mechanism 23*f* of the refresh roller 23, and the motor 33*e* and the moving mechanism 33*f* of the refresh roller 33, respectively. Under the control of the CPU 400, the motors 23*e* and 33*e* can rotationally drive the refresh rollers 23 and 33 with the first and second rubbing circumferential speeds, respectively. Still further, under the control of the CPU 400, the moving mechanisms 23*f* and 33*f* can move the refresh rollers 23 and 33, respectively, in the direction of coming into contact with and separating from the fixing rollers 21 and 31.

[Rubbing Operation of Refresh Roller]

According to the present embodiment, the image forming apparatus 100 eliminates flaws and gloss unevenness on images otherwise caused by the surface roughnesses of the fixing rollers 21 and 31 set by the passage of the sheet P as described above by using the refresh rollers 23 and 33. It is noted that although the rubbing conditions of the rubbing operation performed by the refresh rollers 23 and 33, such as the force of the moving mechanisms 23*f* and 33*f* pressing the refresh rollers 23 and 33 against the fixing rollers 21 and 31 (refreshing pressure, pressure) are different, the operations themselves are the same. Then, the rubbing operation of the refresh roller 23 (a first roughening process) will be described first.

The refresh roller 23 imprints fine rubbing flaws on the entire longitudinal areas (passing part, non-passing part and coba part) of the fixing roller 21 by rubbing the surface of the fixing roller 21 rotating with the first circumferential speed while being in contact with the surface of the fixing roller 21. Here, the large number of fine rubbing flaws imprinted by the refresh roller 23 is invisible on the image formed onto the sheet P at the first fixing apparatus 20. The difference in the irregularities generated longitudinally on the surface of the fixing roller 21 is eliminated by the fine rubbing flaws imprinted by the refresh roller 23. The image forming apparatus 100 can set the surface roughness of the fixing roller 21 to the desirable surface roughness, i.e., can improve the surface roughness of the fixing roller 21, by the rubbing operation of the refresh roller 23 as described above. Because the surface of the fixing roller 21 is set at the desirable surface roughness by the refresh roller 23, it becomes possible to eliminate a low gloss stripe, at the position corresponding to the coba part 213, and a gloss level difference between the passing part 211 and the non-passing part 212 on the image of the sheet P that has passed through the first fixing apparatus 20.

As described above, the initial surface roughness of the fixing roller 21 including the releasing layer 21*d*, such as the fluororesin, as the surface layer is around Rz 0.1 μm to 0.3 μm in shipping the product. The surface roughness of the fixing roller 21 is changed to around Rz 0.5 μm to 2.0 μm by the attack of the burr and others of the sheet P. In contrast, according to the present embodiment, the refresh roller 23 imprints the rubbing flaws such that the surface roughness of the fixing roller 21 becomes more than Rz 0.5 μm and less than 1.5 μm along a rotation direction of the fixing roller 21. Here, the refresh roller 23 imprints rubbing flaws whose longitudinal width is less than 10 μm such that ten or more such rubbing flaws are formed per each 100 μm in the longitudinal direction of the fixing roller 21. This arrangement makes it possible to restore the surface roughness of the fixing roller 21 to the desirable surface roughness.

It is noted that a purpose of the rubbing operation of the refresh roller 23 is to imprint the fine rubbing flaws on the surface of the fixing roller 21, and it is not the purpose to scrape the surface of the fixing roller 21 to let a new surface emerge. That is, the rubbing operation of the refresh roller 23 is not what polishes the surface of the fixing roller 21. Rather, its purpose is to set the surface of the fixing roller 21 to the desirable surface roughness by imprinting irregularities at a level of so-called embossing. Therefore, although the releasing layer 21*d* of the fixing roller 21 is scraped more or less by the refresh roller 23, the degree of the scrape is at a level unmeasurable or within a measurement error over the life of the fixing roller 21.

The image forming apparatus 100 executes the rubbing operation by the refresh roller 23 at the adequate timing of the non-fixing time of the first fixing apparatus 20 as described above. It is noted that it is not necessary to execute the rubbing operation by the refresh roller 23 at every non-fixing time. The timing for executing the rubbing operation by the refresh roller 23 may be arranged such that the rubbing operation is automatically executed during the non-fixing time when the number of processed sheets P passing through the first fixing apparatus 20 and counted by a processing counter 24 (see FIG. 19) for example, reaches a predetermined value. The image forming apparatus 100 may be also arranged to execute the rubbing operation by the refresh roller 23 when the image forming apparatus 100 receives an input through the manipulation portion 401 from the user, who is concerned about the gloss unevenness on the image, requesting execution of the rubbing operation.

More specifically, for example, the CPU 400 of the image forming apparatus 100 counts the number of sheets that have passed through the first fixing apparatus 20 in fixing images on sheets P whose widthwise size is smaller than A3 size sheet and executes the rubbing operation by the refresh roller 23 when the accumulated value of the number of sheets that have passed through the first fixing apparatus 20 exceeds a first value. Here, it is preferable to set the first value within a range of 100 to 1000 sheets for example, and it is set at 500 sheets in this example. In the rubbing operation of the refresh roller 23, the CPU 400 operates the moving mechanism 23*f* of the refresh roller 23 in a state in which an image forming operation is once halted to bring the refresh roller 23 into contact with the fixing roller 21. If a mechanism for keeping the pressure roller 22 away from the fixing roller 21 is provided here, the CPU 400 keeps the pressure roller 22 away from the fixing roller 21 at the moment when the refresh roller 23 comes into contact with the fixing roller 21. After keeping the pressure roller 22 away from the fixing roller 21, the CPU 400 rotationally drives the fixing roller 21 at a predetermined circumferential speed, e.g., at a circumferential speed equal to the circumferential speed in forming an image for example. Next, the CPU 400 rotationally drives the refresh roller 23 by the motor 23*e* until a time when a first rubbing time set in advance elapses with the first rubbing circumferential speed having the first circumferential speed difference with respect to the circumferential speed of the fixing roller 21. After the elapse of the first rubbing time, the CPU 400 ends the rubbing operation of the refresh roller 23 and executes the image forming operation again by keeping the refresh roller 23 away from the fixing roller 21.

It is noted that the image forming apparatus 100 may be arranged so as to execute the rubbing operation by the refresh roller 23 only when the sheet size is changed because the coba flaws are liable to be conspicuous when the sheet P is changed to a sheet whose size is larger than the sheet presently processed as described above. This arrangement makes it possible for the image forming apparatus 100 to prolong the lives of the fixing roller 21 and the refresh roller 23.

Next, the rubbing operation of the refresh roller 33 (a second roughening process) will be described. Even if coba flaws are generated as gloss unevenness on the image surface in the first fixing apparatus 20, the difference of glossiness becomes minor if the sheet on which the image has been formed passes through the second fixing apparatus 30 because the surface of the sheet is melted again. To that end, under the condition in which the sheet passes through two or more heated nips, the fixed image on the sheet is more affected by the fixing roller 31 of the second, downstream fixing apparatus 30 downstream in the sheet conveying direction of the first fixing apparatus 20. As described above, the CPU 400 passes the sheet P whose basis weight is less than 150 g/m$^2$ only through the first fixing apparatus 20 also in the present embodiment. Still further, the CPU 400 increases the control temperature of the fixing apparatus for a sheet whose basis weight is large in order to assure fixability and to gloss the image even on the sheet whose basis weight is large. Therefore, the CPU 400 increases refreshing frequency most when the sheet is glossy and the temperature of the second fixing apparatus 30 is high. Otherwise, the CPU 400 drops the frequency.

[Execution Timing of Rubbing Operation]

Figure 20:
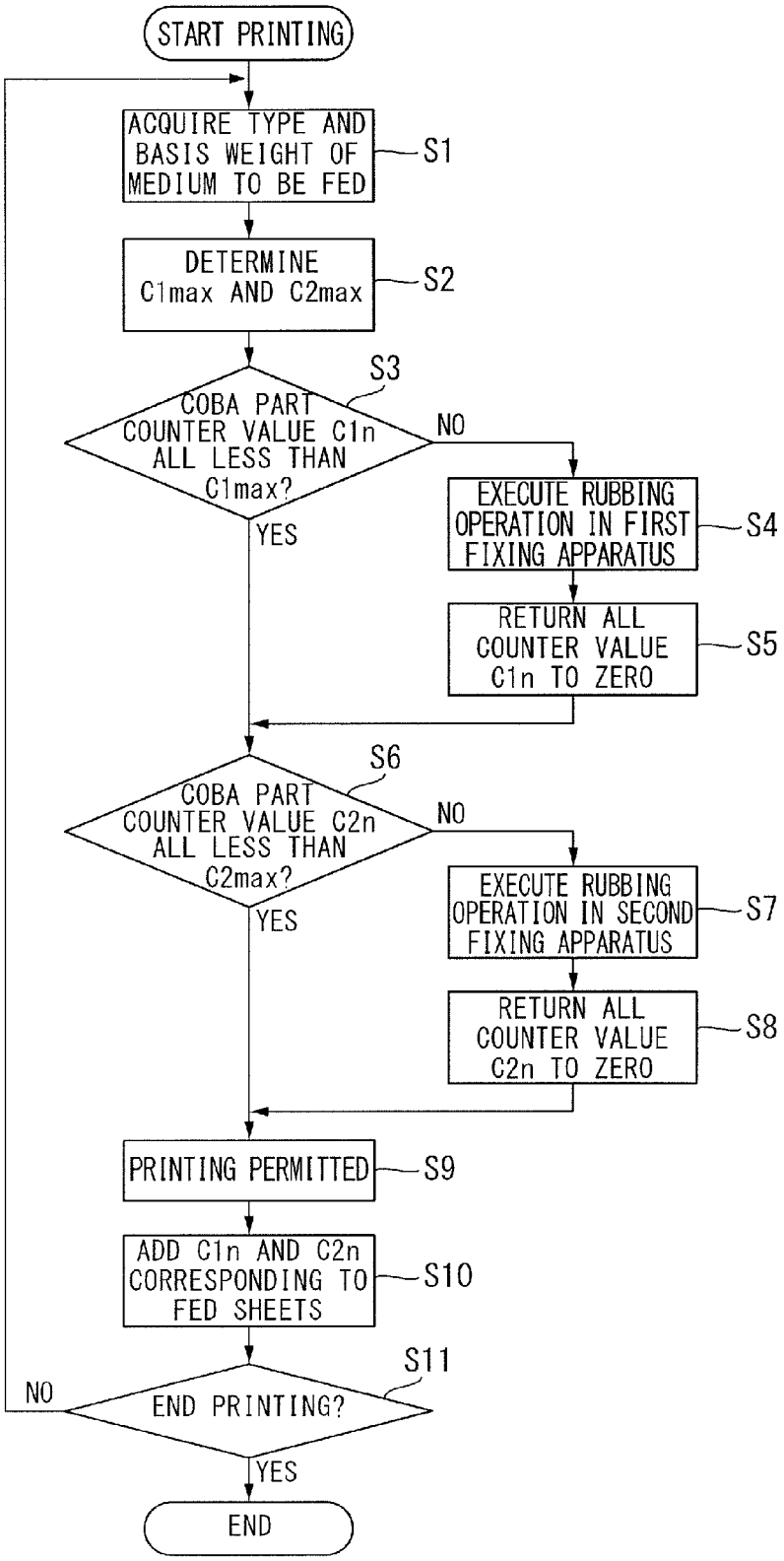
FIG. 20 is a flowchart illustrating a rubbing operation of the first and second rubbing members of the first embodiment.

FIG. 20 is a flowchart detailing the timings for executing the respective rubbing operations of the refresh rollers 23 and 33 of the present embodiment.

Here, the CPU 400 of the image forming apparatus 100 acquires information from the processing counters 24 and 34 (see FIG. 19). When a sheet P has passed through the first fixing apparatus 20, the processing counter 24 adds the number of sheets that have passed on a processing count C1*n*. When a sheet P has passed through the second fixing apparatus 30, the processing counter 34 adds the number of sheets that have passed on a processing count C2*n*. Also, when a lengthy sheet P whose length in the sheet conveying direction is 221 mm or more, for example, has passed through, the processing counters 24 and 34 add values to the processing counts C1*n* and C2*n* by assuming that two sheets have been processed. It is noted that 'n' appended to each count represents the sheet width, and C1*n* and C2*n* may hold a plurality of values by the sheet width of the sheet P. For instance, when one A3 size plain sheet whose basis weight is 157 g/m$^2$ and whose width is 297 mm is passed through the first and second fixing apparatuses 20 and 30, the count is made by assuming that two sheets have passed through the first and second fixing apparatuses 20 and 30. Therefore, two points are added respectively to the values of C1 (297) and C2 (297). Still further, in a case when a plain LTR size sheet whose basis weight is 64 g/m$^2$ and whose width is 279 mm is set not to pass through the second fixing apparatus 30, one point is added only to C1(279).

The rubbing operation is executed when either one value of these C1*n* and C2*n* exceeds values of C1max and C2max. Here, C1max constitutes the first value in the present embodiment. C2max also constitutes the second value in the present embodiment.

When printing, i.e., an image forming operation, is started, the CPU 400 acquires the type and basis weight of a medium to be fed in Step S1. Then, the CPU 400 determines C1max and C2max by making reference to the information acquired in the process of Step S1 and to information stored in a rubbing operation threshold value table shown in FIG. 21 in Step S2.

Next, the CPU 400 determines whether or not all of the processing counts C1*n* is less than C1max in Step S3. If it is determined that one of the processing count C1*n* is C1max or more in the process of Step S3, i.e., No, the CPU 400 executes the rubbing operation of the refresh roller 23 in Step S4. Next, the CPU 400 zeros all of the processing counts C1*n* in Step S5.

After executing the process in Step S5 or when it is determined that all of the processing counts C1*n* is less than C1max, i.e., Yes, in the process of Step S3, the CPU 400 determines whether or not all of the processing counts C2*n* is less than C2max in Step S6. When it is determined that at least one of the processing count C2*n* is more than C2max in the process in Step S6, i.e., No, the CPU 400 executes the rubbing operation of the refresh roller 33 in Step S7. Next, the CPU 400 zeros all of the processing counts C2*n* in Step S8.

After executing the process of Step S8 or when it is determined that all of the processing counts C2*n* is equal to less than C2max, i.e., Yes, in the process of Step S6, the CPU 400 executes printing in Step S9. Next, the CPU 400 adds the respective processing counts C1*n* and C2*n* corresponding to the sheet P every time when the sheet P passes through the first and second fixing apparatuses 20 and 30 by making reference to the information acquired in the process of Step S10. In this process, the CPU 400 counts the number of sheets P that have passed through the first and second fixing apparatuses 20 and 30 by using the processing counters 24 and 34. Next, the CPU 400 determines whether or not printing has been ended in Step S11. When it is determined that printing has not finished yet in this process, i.e., No, the CPU 400 returns the process to Step S1. When it is determined that printing has been finished in this process, i.e., Yes, the CPU 400 ends the printing process. Thus, the CPU 400 constitutes a rubbing processing portion in the present embodiment. It is noted that in the present embodiment, the arrangement is made to include the processing counters 24 and 34 counting the number of sheets per each width of sheets, the present invention is not limited to such arrangement. The image forming apparatus 100 may be arranged such that the processing counters 24 and 34 count the number of sheets every time when the sheets pass through the first and second fixing apparatuses 20 and 30, regardless the width of the sheets. Still further, the image forming apparatus 100 may be arranged to count that one sheet has passed every time when the sheet passes through, regardless the length in the sheet conveying direction.

[Rubbing Condition of Each Refresh Roller]

FIG. 22 is a table showing the respective rubbing conditions set by the CPU 400 of the image forming apparatus 100 and the surface roughnesses of the fixing rollers 21 and 31 changed by the rubbing operations in executing the rubbing operations by the refresh rollers 23 and 33.

As indicated in a column of the first embodiment in a table in FIG. 22, the image forming apparatus 100 of the present embodiment sets the refreshing pressure applied by the moving mechanism 23*f* to the refresh roller 23 to be 8 kgf as the rubbing condition of the rubbing operation of the refresh roller 23 of the first fixing apparatus 20. Still further, the image forming apparatus 100 sets the abrasive grain composing the rubbing layer 23*c* of the refresh roller 23 to be an abrasive grain whose particle size is No. 2000 and whose roughness is about 7 μm of center particle size as the rubbing condition of the rubbing operation of the refresh roller 23. When the rubbing operation of the refresh roller 23 was executed under these rubbing conditions, the average value of the depths of rubbing flaws on the surface of the fixing roller 21 (surface roughness Rz) was 1.5 μm.

Still further, the image forming apparatus 100 sets the refreshing pressure of the moving mechanism 33*f* at 8 kgf as the rubbing condition of the rubbing operation by the refresh roller 33 of the second fixing apparatus 30. Still further, the image forming apparatus 100 equalizes the frequency for executing the rubbing operation of the refresh roller 33 with the frequency for executing the rubbing operation of the refresh roller 23, i.e., equalizes values of C1max and C2max to the same value, e.g., 1000 per each sheet type. Still further, the image forming apparatus 100 sets the abrasive grain composing the rubbing layer 33*c* of the refresh roller 33 to be abrasive grain of particle size No. 3000 whose roughness is about 4 μm of center particle size as the rubbing condition of the rubbing operation of the refresh roller 33. In this case, the average value of the depths of rubbing flaws on the surface of the fixing roller 31 was 1.0 μm.

That is, in the first example, the surface roughness of the fixing roller 31 set by the rubbing operation of the refresh roller 33 was reduced as compared to the case of the first fixing apparatus 20 by setting the surface roughnesses of the refresh rollers 23 and 33, respectively, as the rubbing conditions.

A second comparative example shown in FIG. 22 is a case when the same conditions as the rubbing conditions of the rubbing operation of the refresh roller 23 described above were used as rubbing conditions of the rubbing operation of the refresh roller 33 of the second fixing apparatus 30. In this case, the average value of the depths of rubbing flaws on the surface of the fixing roller 31 was 1.5 μm.

FIG. 15 described above shows the verification results of the effects performed under such conditions. In the second comparative example, flaws generated by the rubbing operation were slightly seen at part of a high gloss sheet where the density of the toner image is high. Therefore, "Δ" is marked in a column of rubbing flaw of the second comparative example in FIG. 15. Meanwhile, in the first embodiment fulfilling conditions of the present embodiment, no flaw otherwise generated by the rubbing operation was inscribed and the surface roughness of the fixing roller 31 was kept while eliminating the coba flaw in forming an image on the high gloss sheet. Therefore, '○' indicating that a favorable result could be obtained is marked in each column of the coba flaw, the rubbing flaw and image quality of the first embodiment in FIG. 15.

It is noted that the first comparative example in FIGS. 15 and 22 show conditions when no rubbing operation is carried out as described above, and coba flaws are generated in a process of around 2000 sheets. Still further, a third comparative example in FIG. 15 is a case when the contact pressure of the refresh rollers 23 and 33 against the fixing rollers 21 and 31 was set at 4 kgf in both of the first and second fixing apparatuses 20 and 30. In this case, the roughness of the coba part gradually advances if processing on the first fixing apparatus 20 is repeated over and over. Then, after processing around 5000 sheets, coba flaws were generated on a plain sheet and coba flaws were left slightly even on an image surface formed on a thick coated sheet. Therefore, "Δ" indicating that no satisfactory result could be obtained is marked in a column of the coba flaw of the third comparative example in FIG. 15.

[Changes of Surface of Fixing Roller Caused by Rubbing Operation]

Figure 23:
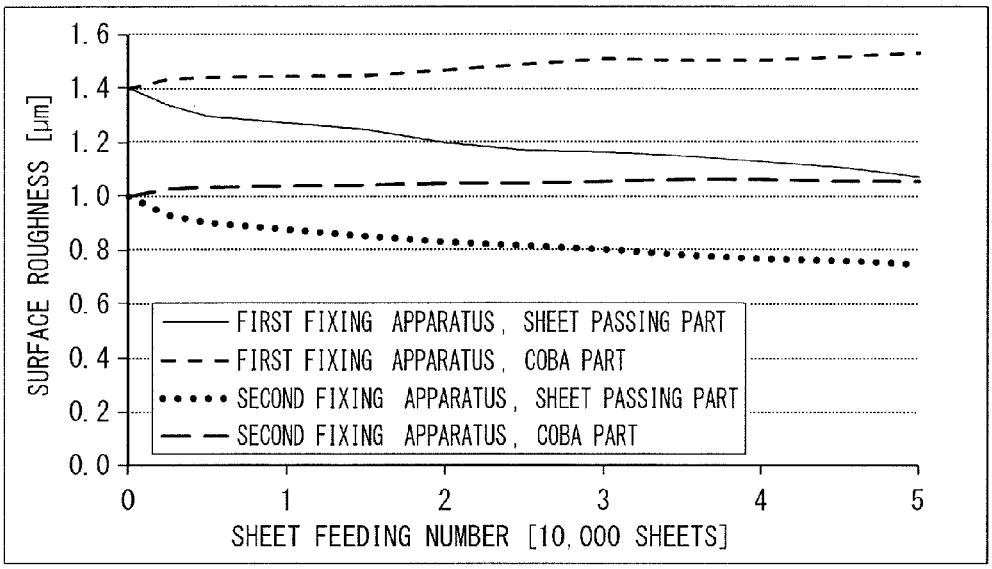
FIG. 23 is a graph showing relationships between numbers of sheets on which images have been fixed and the surface roughnesses of the first and second heating rotators in the image forming apparatus of the first embodiment.

FIG. 23 is a graph illustrating the surface roughnesses of the fixing rollers 21 and 31 when the rubbing operations of the refresh rollers 23 and 33 are periodically executed in the image forming apparatus 100 in which particle size Nos. of the abrasive grains composing the rubbing layers 23*c* and 33*c* are differentiated as a rubbing condition. In the present embodiment, the image forming apparatus 100 forms an image on the plain sheet P of letter size whose basis weight is 216 g/m$^2$. Then, the image forming apparatus 100 executes the rubbing operations of the refresh rollers 23 and 33 every time when the first and second fixing apparatuses 20 and 30 nip and convey 1000 sheets P. At this time, the plain sheet whose burr is as high as 15 μm was selectively used.

As shown in FIG. 23, in terms of the surface roughness of the fixing roller 21 (indicated as 'First Fixing' in FIG. 23), the surface roughness of the passing part 211 varies between Rz 1.0 μm and 1.4 μm by executing the rubbing operation of the refresh roller 23. Still further, in terms of the surface roughness of the fixing roller 21 on which the rubbing operation of the refresh roller 23 is executed, the surface roughness of the coba part 213 varies between Rz 1.4 μm and 1.5 μm. Still further, in terms of the surface roughness of the fixing roller 31 (indicated as 'Second Fixing Apparatus' in FIG. 23), the surface roughness of the passing part 211 varies between Rz 0.7 μm and 1.0 μm and the surface roughness of the coba part 213 varies between Rz 1.0 μm and 1.5 μm by executing the rubbing operation of the refresh roller 33.

Thus, the image forming apparatus 100 can restrain the difference of the surface roughnesses of the passing part 211 of the fixing rollers 21 and 31 and the coba part 213 from increasing by executing the rubbing operations of the refresh rollers 23 and 33 on the surfaces of the fixing rollers 21 and 31. Accordingly, the image forming apparatus 100 can keep the surface roughness in the longitudinal direction of the fixing rollers 21 and 31 substantially homogeneous and can prevent gloss unevenness from being generated on an image formed on the sheet P.

As described above, according to the present embodiment, the image forming apparatus 100 is configured such that the surface roughness of the refresh roller 33 is smaller than the surface roughness of the refresh roller 23. Therefore, the image forming apparatus 100 is configured such that the surface roughness of the fixing roller 31 changed by the rubbing operation of the refresh roller 33 is smaller than the surface roughness of the fixing roller 21 changed by the rubbing operation of the refresh roller 23. As a result, the image forming apparatus 100 maintains the condition in which the surface roughness of the fixing roller 31 is smaller than the surface roughness of the fixing roller 21 by the rubbing operations of the refresh rollers 23 and 33 and can stably maintain the desirable surface roughnesses required on the fixing rollers 21 and 31. Still further, the image forming apparatus 100 can prevent the difference of the surface roughnesses from being otherwise generated by the attack of the sheet P on the respective areas in the longitudinal direction of the fixing roller 21 by the rubbing operation of the refresh roller 23. Due to that, it is possible to prolong the life of the first fixing apparatus 20 and the life of the image forming apparatus 100 as well. Still further, while the image forming apparatus 100 keeps the condition in which the surface roughness of the fixing roller 31 is smaller than the surface roughness of the fixing roller 21, this arrangement makes it possible for the image forming apparatus 100 to form a high quality image which excels in glossiness on the sheet P by re-melting the toner image, which has been fixed by the first fixing apparatus 20, by the fixing roller 31 whose surface roughness is smaller and by fixing to the sheet P in the second fixing apparatus 30. That is, it is possible to provide the image forming apparatus 100 restraining the drop of quality of an output image.

It is noted that in the present embodiment, although the image forming apparatus 100 is configured such that the initial surface roughnesses of the fixing rollers 21 and 31 are different, the present invention is not limited to such configuration. For instance, the image forming apparatus 100 may be arranged such that the initial surface roughnesses of the fixing rollers 21 and 31 are equalized and the surface roughness of the fixing roller 21 is differentiated from the surface roughness of the fixing roller 31 by the rubbing operations of the refresh rollers 23 and 33.

Second Embodiment

A second embodiment of the present invention will be described by using FIG. 24 and by making reference to FIGS. 1 through 23. In the first embodiment described above, the surface roughness of the refresh roller 23 of the first fixing apparatus 20 is configured to be larger than the surface roughness of the refresh roller 33 of the second fixing apparatus 30. This configuration makes it possible for the image forming apparatus 100 to maintain the condition in which the surface roughness of the fixing roller 21 of the first fixing apparatus 20 is larger than the surface roughness of the fixing roller 31 of the second fixing apparatus 30. However, such a configuration ends up increasing the manufacturing costs of the image forming apparatus because the refresh rollers 23 and 33 whose surface roughnesses are different are required.

As shown in FIG. 24, the CPU 400 sets a rubbing operation threshold value table such that the value of C2max, i.e., the second value, is higher than C1max, i.e., the first value, in processing any sheet P by each fixing apparatus in the present embodiment. The image forming apparatus 100 is configured to execute the rubbing operation of the refresh roller 23 more frequently than the rubbing operation of the refresh roller 33 by setting the value of C1max to be lower than the value of C2max.

Because the value of C1max is set to be a half of the value of C2max, the CPU 400 executes each process shown in FIG. 20 and described above and executes the rubbing operations of the refresh roller 23 with frequency of almost twice of the frequency of the rubbing operations of the refresh roller 33. Because the refreshing pressure and the surface roughnesses of the refresh rollers 23 and 33 of the present embodiment are the same as 4 kgf and No. 2000, respectively, as described above, the capabilities of the refresh rollers 23 and 33 of roughening the surface layers of the fixing rollers 21 and 31 per unit time are equal. Therefore, the surface layer of the fixing roller 21 on which the rubbing operations of the refresh roller 23 are more frequently executed is roughened more than the surface layer of the fixing roller 31. It is noted that if the rubbing operations of the refresh roller 33 are executed on the fixing roller 31 with the conventional frequency equal to that of the fixing roller 21, the rubbing flaws generated by the refresh roller 33 become problematic as described above. However, the frequency of the rubbing operations of the refresh roller 33 is lowered to be less than the frequency of the rubbing operations of the refresh roller 23 in the present embodiment. Therefore, because many sheets are processed and the fixing roller 31 is rubbed more by the pressure roller 32 during a period of time since when the rubbing operation of the refresh roller 33 has been executed and is executed again, the depth of rubbing stripes generated by the rubbing operation of the refresh roller 33 is shortened. Accordingly, the overlapped rubbing stripes will not grow to a level recognizable on an image, and the surface roughness of the fixing roller 31 may be kept in the desirable condition.

A second example in FIG. 15 shows results obtained when an image was formed on the sheet P by differentiating the frequencies of the rubbing operations of the refresh rollers 23 and 33. As shown in FIG. 15, it was possible to eliminate coba flaws and rubbing flaws while satisfying image quality also in the second example in the same manner as the first example. Due to that, '○' indicating that a favorable result could be obtained is marked in each column of coba flaw, rubbing flaw and image quality of the second embodiment in FIG. 15.

As described above, the image forming apparatus 100 is configured such that the execution frequency of the rubbing operations of the refresh roller 23 is higher than the execution frequency of the rubbing operations of the refresh roller 33 in the present embodiment. Due to that, the surface roughness of the fixing roller 31 set by the rubbing operation of the refresh roller 33 is smaller than the surface roughness of the fixing roller 21 set by the rubbing operation of the refresh roller 23 in the image forming apparatus 100. This arrangement makes it possible for the image forming apparatus 100 to maintain the condition in which the surface roughness of the fixing roller 21 is larger than the surface roughness of the fixing roller 31 by the rubbing operations of the refresh rollers 23 and 33 and to stably maintain the desirable surface roughnesses required of the fixing rollers 21 and 31. Still further, the image forming apparatus 100 can prevent the surface roughnesses of the respective areas in the longitudinal direction of the fixing roller 21 from being differentiated by the attack of the sheet P by executing the rubbing operation of the refresh roller 23. Therefore, it is possible to prolong the life of the first fixing apparatus 20 and the life of the image forming apparatus 100 as well. Still further, the image forming apparatus 100 maintains the condition in which the surface roughness of the fixing roller 31 is smaller than the surface roughness of the fixing roller 21. As a result, the image forming apparatus 100 can form a high quality image which excels in glossiness on the sheet P by re-melting and fixing the toner image, which has been fixed once by the first fixing apparatus 20, by the second fixing apparatus 30 having the fixing roller 31 whose surface roughness is small. Still further, the image forming apparatus 100 can commonize the refresh rollers 23 and 33 and can cut the product cost by equalizing the surface roughnesses of the refresh rollers 23 and 33. However, the arrangement of the first embodiment is preferable from an aspect that no complicated control is required.

Other Embodiments

In the first embodiment described above, the image forming apparatus 100 is arranged such that the surface roughness of the refresh roller 23 is larger than the surface roughness of the refresh roller 33 as a rubbing condition. Still further, in the second embodiment described above, the image forming apparatus 100 is configured such that the frequency of the rubbing operations of the refresh roller 23 is higher than the frequency of the rubbing operations of the refresh roller 33 as a rubbing condition. The surface roughnesses of the fixing rollers 21 and 31 are differentiated by the refresh rollers 23 and 33 by these arrangements in the first and second embodiments. However, the image forming apparatus 100 of the present invention is not limited to such arrangements as long as the rubbing conditions are set such that the surface roughness of the fixing roller 21 set by the rubbing operation of the refresh roller 23 is different from the surface roughness of the fixing roller 31 set by the rubbing operation of the refresh roller 33.

For instance, as indicated in a third example shown in FIG. 22, the force pressing the refresh roller against the fixing roller (refreshing pressure, total pressure) may be differentiated. That is, the refreshing pressure of the refresh roller 23 is increased as compared to a refreshing pressure of the refresh roller 33. More specifically, as a rubbing condition of the rubbing operation of the refresh roller 23, the refreshing pressure of the refresh roller 23 is set at 8 kgf and the refreshing pressure of the refresh roller 33 is set at 4 kgf. Still further, the abrasive grains composing the rubbing layers 23*c* and 33*c* of the refresh rollers 23 and 33 are those whose particle size Nos. are both No. 2000 in the third embodiment. Still further, the contact area between the refresh roller 23 and the fixing roller 21 is equalized with the contact area between the refresh roller 33 and the fixing roller 31.

Accordingly, the force per unit area applied between the refresh roller 33 and the fixing roller 31 (contact pressure, pressure) when the refresh roller 33 rubs the fixing roller 31 is smaller than the force per unit area (contact pressure, pressure) generated between the refresh roller 23 and the fixing roller 21.

When the rubbing operation of the refresh roller 23 was executed under the rubbing conditions of the third example, the average value of depth of rubbing flaws on the surface of the fixing roller 21 was 1.5 μm. It is noted that the image forming apparatus 100 of the third embodiment is arranged such that the surface roughness of the fixing roller 21 converges to 1.5 μm when the refresh roller 23 travels on the surface of the fixing roller 21 by 50 meters or more. At this time, the refresh roller 23 functions as a roughening member roughening the surface roughness of the fixing roller 21 to 1.5 μm.

When the rubbing operation of the refresh roller 33 was executed under the rubbing conditions of the third example, the average value of depth of rubbing flaws on the surface of the fixing roller 31 was 1.0 μm. It is noted that the image forming apparatus 100 of the third example is arranged such that the surface roughness of the fixing roller 31 converges to 1.0 μm when the refresh roller 33 travels on the surface of the fixing roller 31 by 50 meters or more. At this time, the refresh roller 33 functions as a roughening member roughening the surface roughness of the fixing roller 31 to 1.0 μm.

As shown in the third example in FIG. 15, it was possible to maintain the condition of the surface of the fixing roller while eliminating rubbing flaws and coba flaws also in the arrangement of the third example. Due to that, '○' indicating that a favorable result could be obtained is marked in each column of coba flaw, rubbing flaw and image quality of the third example in FIG. 15.

It is possible to reduce the size of the surface roughness of the fixing roller 31 changed by the rubbing operation of the refresh roller 33 to be smaller than the surface roughness of the fixing roller 21 changed by the rubbing operation of the refresh roller 23 in the same manner with the first and second embodiments by the setting operation as described above. Still further, the arrangement of the third example is preferable more than the second embodiment from the perspective that no complicated control is required. Still further, the third example is preferable more than the first embodiment from the perspective that the same refresh rollers can be adopted to the refresh rollers 23 and 33.

A fourth comparative example shown in FIG. 15 is a case of eliminating coba flaws by preparing a refresh roller by abrasive grains whose particle size No. is 800 (whose center particle size is about 14 μm) and by causing the refresh roller to be driven by the fixing roller. In this case, the surface layer of the fixing roller was roughened more than necessary and glossiness on the image largely dropped even if a time was taken to a level by which coba flaws becomes unnoticeable. Still further, a long refreshing time was taken, increasing the downtime. Due to that, "Δ" indicating that a satisfactory result could not be obtained is marked in a column of image quality of the fourth comparative example in FIG. 15.

Still further, the image forming apparatus 100 may be arranged to differentiate rubbing times in the respective refreshing times as a rubbing condition. For instance, the CPU 400 may set a second rubbing time to be shorter than a first rubbing time. This arrangement makes it possible for the image forming apparatus 100 to increase the surface roughness of the fixing roller 21 changed by one time of rubbing operation of the refresh roller 23 more than the surface roughness of the fixing roller 31 changed by one time of rubbing operation of the refresh roller 33. Here, the CPU 400 functions as a time setting portion.

Still further, the image forming apparatus 100 may be arranged to differentiate the temperatures of the fixing rollers 21 and 31 in executing the rubbing operations by the refresh rollers 23 and 33 as a rubbing condition for example. As described above, the releasing layers 21*d* and 31*d* of the fixing rollers 21 and 31 are composed of the fluororesin that is softened as the temperature increases. Then, the CPU 400 controls the heat sources 21*a* and 31*a* such that the first temperature detected by the temperature sensor 21*e* is higher than the second temperature detected by the temperature sensor 31*e* in executing the rubbing operations of the refresh rollers 23 and 33. This arrangement makes it possible for the image forming apparatus 100 to generate a difference between the hardness of the surface of the fixing roller 21 and the hardness of the surface of the fixing roller 31 even if the other rubbing conditions are the same. Accordingly, the image forming apparatus 100 can differentiate the surface roughnesses of the fixing rollers 21 and 31 set by the rubbing operations of the refresh rollers 23 and 33 even if the other rubbing conditions are the same.

Still further, the image forming apparatus 100 can set the surface roughnesses of the fixing rollers 21 and 31, set by the refresh rollers 23 and 33, by combining a plurality of rubbing conditions described above.

Still further, although the refresh rollers 23 and 33 are configured to be driven respectively by their own motors 23*e* and 33*e* in the embodiments described above, the present invention is not limited to such configuration. For instance, the refresh rollers 23 and 33 may be arranged to be rotationally driven by power of motors 21*f* and 31*f* by connecting driving shafts of the motors 21*f* and 31*f* rotating the fixing rollers 21 and 31 by a gear. In this case, the refresh rollers 23 and 33 are rotationally driven with a circumferential speed of twice the circumferential speed of the fixing rollers 21 and 31 by connecting the driving shafts of the motors 21*f* and 31*f*, i.e., the fixing rollers 21 and 31 with the refresh rollers 23 and 33, with a 1:2 of gear ratio.

Still further, although the refresh rollers 23 and 33 are composed of the rubbing rotators, respectively, in the embodiments described above, the present invention is not limited to such configuration. For instance, it is also possible to configure the apparatus such that a fixed surface on which the rubbing material is applied comes into contact with the fixing rollers 21 and 31.

Still further, although the arrangement in which the refresh rollers 23 and 33 are brought into contact with and kept away from the fixing rollers 21 and 31 by the moving mechanisms 23*f* and 33*f* are made in the embodiments described above, the image forming apparatus 100 may not always include the moving mechanisms 23*f* and 33*f*. For instance, an arrangement can be made such that the refresh roller 23 is continuously kept in contact with the fixing roller 21 so as to keep the surface of the fixing roller 21 at predetermined surface roughness. In the same manner, the image forming apparatus 100 may be arranged such that the refresh roller 33 is continuously kept in contact with the fixing roller 31 so as to keep the surface of the fixing roller 31 at a predetermined surface roughness. In the case when the image forming apparatus 100 is arranged as described above, the configuration of the first embodiment is desirable from the perspective of restraining wear of the fixing rollers 21 and 31 and of prolonging the lives of the fixing rollers 21 and 31 because the wears of the fixing rollers 21 and 31 advance by the refresh rollers 23 and 33.

Still further, although the fixing and pressure rollers are exemplified as the heating and pressing rotators in the embodiments described above, the heating and pressing rotators may be a belt unit in which a belt is wrapped around a plurality of rollers.

It was confirmed from the abovementioned embodiments that the surfaces of the fixing rollers can be maintained favorably by differentiating the rubbing conditions (refreshing conditions) in the first and second fixing apparatuses 20 and 30. These conditions are applicable as long as there are a fixing member and a member (rubbing member) which changes the surface natures of the fixing member. While it is necessary to finely adjust the specifications of the rubbing member in order to be compatible with various imaginable apparatuses, imagability, the roughening ability of the rubbing member is preferable to hold the relationship of the first fixing apparatus 20> the second fixing apparatus 30.

Embodiments of the present invention can also be realized by a computer of a system or apparatus that reads out and executes computer executable instructions, e.g., one or more programs recorded on a storage medium (which may also be referred to more fully as a 'non-transitory computer-readable storage medium') to perform the functions of one or more of the above-described embodiments and/or that includes one or more circuits, e.g., application specific integrated circuit (ASIC), for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may include one or more processors, e.g., central processing unit (CPU) and micro processing unit (MPU), and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-143330, filed on Jul. 11, 2014 which is hereby incorporated by reference herein in its entirety.

What is claimed is:

1. An image forming apparatus, comprising:

an image forming portion forming a toner image on a sheet;

a first heating rotator and a first pressing rotator forming a fixing nip fixing the non-fixed toner image formed in the image forming portion onto the sheet;

a second heating rotator and a second pressing rotator forming a heating nip heating the fixed toner image on a predetermined sheet that has passed through the fixing nip;

a first rubbing member rubbing a range of a surface of the first heating rotator contactable with the sheet;

a first contact/separate portion bringing the first rubbing member into contact with and keeping the first rubbing member away from the first heating rotator, the first contact/separate portion bringing the first rubbing member into contact with the first heating rotator in executing a first roughening process to the first heating rotator;

a second rubbing member rubbing a range of a surface of the second heating rotator contactable with the sheet; and a second contact/separate portion bringing the second rubbing member into contact with and keeping the second rubbing member away from the second heating rotator, the second contact/separate portion bringing the second rubbing member into contact with the second heating rotator in executing a second roughening process to the second heating rotator, wherein surface roughness of the second heating rotator on which the second roughening process has been executed is smaller than surface roughness of the first heating rotator on which the first roughening process has been executed.

2. The image forming apparatus according to claim 1, wherein the surface roughness of the first heating rotator on which the first roughening process has been executed is to be equal to or more than Rz 0.5 μm and to be equal to or less than 1.5 μm.

3. The image forming apparatus according to claim 1, wherein the surface roughness of the second heating rotator on which the second roughening process has been executed is to be equal to or more than Rz 0.2 μm and to be equal to or less than 1.0 μm.

4. The image forming apparatus according to claim 1, wherein the force per unit area applied between the second heating rotator and the second rubbing member during the second roughening process is smaller than the force per unit area applied between the first heating rotator and the first rubbing member during the first roughening process.

5. The image forming apparatus according to claim 4, wherein the second contact/separate portion includes a second press portion pressing the second rubbing member toward the second heating rotator and, the first contact/separate portion includes a first press portion pressing the first rubbing member toward the first heating rotator, wherein the pressure produced by the second press portion is smaller than the pressure produced by the first press portion.

6. The image forming apparatus according to claim 1, wherein the surface roughness of the second rubbing member is smaller than the surface roughness of the first rubbing member.

7. The image forming apparatus according to claim 1, further comprising a control portion controlling the first contact/separate portion to execute the first roughening process on the first heating rotator in a case when a predetermined number of sheets has passed through the fixing nip and controlling the second contact/separate portion to execute the second roughening process on the second heating rotator in a case when a different predetermined number of sheets has passed through the heating nip.

8. The image forming apparatus according to claim 1, wherein the predetermined sheet is a coated sheet.

9. The image forming apparatus according to claim 1, wherein the first rubbing member is a first rubbing rotator rubbing the surface of the first heating rotator by coming into contact with the first heating rotator with a peripheral speed difference, and the second rubbing member is a second rubbing rotator rubbing the surface of the second heating rotator by coming into contact with the second heating rotator with a peripheral speed difference.

10. An image forming apparatus, comprising:

an image forming portion forming a toner image on a sheet; a first heating rotator and a first pressing rotator forming a fixing nip fixing the non-fixed toner image formed in the image forming portion onto the sheet;

a second heating rotator and a second pressing rotator forming a heating nip heating the fixed toner image on a predetermined sheet that has passed through the fixing nip;

a first rubbing member keeping a range of the first heating rotator contactable with the sheet at a predetermined surface roughness by rubbing a surface of the first heating rotator; and a second rubbing member keeping a range of the second heating rotator contactable with the sheet at a surface roughness smaller than the predetermined surface roughness by rubbing a surface of the second heating rotator.

11. The image forming apparatus according to claim 10, wherein the surface roughness of the first heating rotator is to be equal to or more than Rz 0.5 μm and to be equal to or less than 1.5 μm.

12. The image forming apparatus according to claim 10, wherein the surface roughness of the second heating rotator is to be equal to or more than Rz 0.2 μm and to be equal to or less than 1.0 μm.

13. The image forming apparatus according to claim 10, wherein the force per unit area applied between the second heating rotator and the second rubbing member during the second roughening process is smaller than the force per unit area applied between the first heating rotator and the first rubbing member during the first roughening process.

14. The image forming apparatus according to claim 13, further comprising:

a first press portion pressing the first rubbing member toward the first heating rotator; and a second press portion pressing the second rubbing member toward the second heating rotator, wherein the pressure of the second press portion is smaller than the pressure of the first press portion.

15. The image forming apparatus according to claim 10, wherein the surface roughness of the second rubbing member is smaller than the surface roughness of the first rubbing member.

16. The image forming apparatus according to claim 10, wherein the predetermined sheet is a coated sheet.

17. The image forming apparatus according to claim 10, wherein the first rubbing member is a first rubbing rotator rubbing the surface of the first heating rotator by coming into contact with the first heating rotator with a peripheral speed difference, and the second rubbing member is a second rubbing rotator rubbing the surface of the second heating rotator by coming into contact with the second heating rotator with a peripheral speed difference.

18. An image forming apparatus, comprising:

an image forming portion forming a toner image on a sheet; a first heating rotator and a first pressing rotator forming a fixing nip fixing the non-fixed toner image formed in the image forming portion onto the sheet;

a second heating rotator and a second pressing rotator forming a heating nip heating the fixed toner image on a predetermined sheet that has passed through the fixing nip;

a first rubbing member rubbing a range of a surface of the first heating rotator contactable with the sheet;

a first contact/separate portion bringing the first rubbing member into contact with and keeping the first rubbing member away from the first heating rotator, the first contact/separate portion bringing the first rubbing member into contact with the first heating rotator in executing a first roughening process to the first heating rotator;

a second rubbing member rubbing a range of a surface of the second heating rotator contactable with the sheet;

a second contact/separate portion bringing the second rubbing member into contact with and keeping the second rubbing member away from the second heating rotator, the second contact/separate portion bringing the second rubbing member into contact with the second heating rotator in executing a second roughening process to the second heating rotator; and a control portion controlling the first contact/separate portion to execute the first roughening process on the first heating rotator in a case when the number of predetermined sheets passing through the fixing nip counted in performing image forming operations consecutively on a plurality of the predetermined sheets has become a first value, and controlling the second contact/separate portion to execute the second roughening process on the second heating rotator in a case when the number of the predetermined sheets counted in passing through the heating nip becomes a second value which is greater than the first value.

19. The image forming apparatus according to claim 18, wherein the surface roughness of the first heating rotator on which the first roughening process has been executed is to be equal to or more than Rz 0.5 μm and to be equal to or less than 1.5 μm.

20. The image forming apparatus according to claim 18, wherein the surface roughness of the second heating rotator on which the second roughening process has been executed is to be equal to or more than Rz 0.2 μm and to be equal to or less than 1.0 μm.

21. The image forming apparatus according to claim 18, wherein the predetermined sheet is a coated sheet.

22. The image forming apparatus according to claim 18, wherein the first rubbing member is a first rubbing rotator rubbing the surface of the first heating rotator by coming into contact with the first heating rotator with a peripheral speed difference, and the second rubbing member is a second rubbing rotator rubbing the surface of the second heating rotator by coming into contact with the second heating rotator with a peripheral speed difference.

* * * * *